US005777253A

United States Patent [19]

Kurebayashi

[11] Patent Number: 5,777,253

[45] Date of Patent: Jul. 7, 1998

[54] AUTOMATIC ACCOMPANIMENT BY ELECTRONIC MUSICAL INSTRUMENT

[75] Inventor: Kiyomi Kurebayashi, Shimada, Japan

[73] Assignee: Kabushiki Kaisha Kawai Gakki Seisakusho, Shizuoka-ken, Japan

[21] Appl. No.: 769,725

[22] Filed: Dec. 18, 1996

[30] Foreign Application Priority Data

Dec. 22, 1995 [JP] Japan ..... 7-350470

[51] Int. Cl.[6] ..... G10H 1/38

[52] U.S. Cl. ..... 84/613; 84/637; 84/DIG. 22

[58] Field of Search ..... 84/609–614, 634–638, 84/DIG. 22

[56] References Cited

U.S. PATENT DOCUMENTS

| | | | |
|---|---|---|---|
| 4,708,046 | 11/1987 | Kozuki | 84/DIG. 22 |
| 4,981,066 | 1/1991 | Kakizaki | 84/DIG. 22 |
| 5,052,267 | 10/1991 | Ino | 84/613 |
| 5,113,744 | 5/1992 | Tanaka et al. | 84/634 |
| 5,363,735 | 11/1994 | Kondo | 84/634 X |
| 5,393,927 | 2/1995 | Aoki | 84/634 X |
| 5,461,192 | 10/1995 | Imaizumi | 84/634 |
| 5,481,066 | 1/1996 | Kitamura | 84/637 |
| 5,561,256 | 10/1996 | Aoki et al. | 84/637 X |
| 5,602,357 | 2/1997 | Aoki et al. | 84/634 |
| 5,623,112 | 4/1997 | Ito et al. | 84/610 X |

FOREIGN PATENT DOCUMENTS 61-158400 7/1986 Japan .

*Primary Examiner*—Stanley J. Witkowski
*Attorney, Agent, or Firm*—Christie, Parker & Hale, LLP

[57] ABSTRACT

An automatic accompaniment apparatus includes a storage section for storing a plurality of accompaniment patterns. Each of the plurality of accompaniment patterns corresponds to an automatic accompaniment data. One of the plurality of accompaniment patterns is selected by a selecting section based on an input specifying data, and then one of the plurality of accompaniment data corresponding to the selected accompaniment pattern is selected. An accompaniment sound signal generating section generates an accompaniment sound signal based on the selected automatic accompaniment data by the selecting section.

23 Claims, 18 Drawing Sheets

Fig. 4

| CHORD TYPE | ADDRESS |
|---|---|
| maj | READ ADDRESS ADR1 FOR FIRST ACCOMPANIMENT SUB-PATTERN |
| min | |
| m7 | READ ADDRESS ADR2 FOR SECOND ACCOMPANIMENT SUB-PATTERN |
| 7th | |
| OTHERS | READ ADDRESS ADR3 FOR SYNTHETIC ACCOMPANIMENT SUB-PATTERN |

34

Fig. 14

| NOTE COUNT | ADDRESS |
|---|---|
| 4 > | READ ADDRESS ADR1 FOR FIRST ACCOMPANIMENT SUB-PATTERN |
| 4 ≦ | READ ADDRESS ADR3 FOR SYNTHETIC ACCOMPANIMENT SUB-PATTERN |

34

Fig. 20

| REST LENGTH | ADDRESS |
|---|---|
| QUATER REST ≦ | READ ADDRESS ADR1 FOR FIRST ACCOMPANIMENT SUB-PATTERN |
| QUATER REST > | READ ADDRESS ADR3 FOR SYNTHETIC ACCOMPANIMENT SUB-PATTERN |

34

KEYBOARD EVENT PROCESSING ROUTINE

AUTOMATIC ACCOMPANIMENT PROCESSING ROUTINE

KEYBOARD EVENT PROCESSING ROUTINE

AUTOMATIC ACCOMPANIMENT BY ELECTRONIC MUSICAL INSTRUMENT

BACKGROUND OF THE INVENTION

1. Field of the Invention

The present invention relates to an electronic musical instrument, and more particularly to automatic accompaniment in the electronic musical instrument in which the automatic accompaniment is performed in accordance with the automatic accompaniment data stored in a memory.

2. Description of Related Art

An automatic accompaniment apparatus is conventionally known which generates an automatic accompaniment sound based on an accompaniment pattern corresponding to a rhythm which is specified by a user. In such an automatic accompaniment apparatus, automatic accompaniment data necessary to perform automatic accompaniment of one measure to a few of measures is stored in a memory. When start of the automatic accompaniment is instructed, the automatic accompaniment data is read from the memory and an automatic accompaniment sound is generated based on the read automatic accompaniment data. If the automatic accompaniment sound generation is once started, the reading operation of the automatic accompaniment data is repeated until stop of the automatic accompaniment is instructed. Therefore, the accompaniment pattern composed of measures of a relatively small number, i.e., one or a few is repeatedly generated. For this reason, there is a problem in that the automatic accompaniment becomes monotonous.

FIG. 1A is a diagram illustrating an automatic accompaniment data for realizing chord accompaniment of 2 measures. A music score when the automatic accompaniment data of 2 measures is performed by the conventional automatic accompaniment apparatus is illustrated in FIG. 1B. As shown in this example, if a chord is specified by a keyboard unit, the chord (the chord component sound) changes in the order of C→Em→Dm7→G7 in accordance with the specification. However, the accompaniment pattern does not change. Therefore, 2 measures in the first half and 2 measures of the second half have the same accompaniment pattern as shown in FIG. 1A. Further, even if many measures are performed thereafter, the accompaniment pattern of the 2 measures is only repeated. For this reason, there is a problem in that the accompaniment becomes monotonous. To solve such a problem, it is necessary to produce an accompaniment pattern composed of the many number of measures. It is made possible for perform automatic accompaniment to be performed having full of variety while avoiding the monotonous pattern. However, if the accompaniment pattern is composed of many measures, because the quantity of automatic accompaniment data increases, a large capacity of memory is required, resulting in cost up.

On the other hand, an automatic accompaniment apparatus has been developed in which automatic accompaniment is performed based on the automatic accompaniment data produced by a user. In the automatic accompaniment apparatus, the number of measures of the automatic accompaniment pattern to be produced is determined in advance and then automatic accompaniment data corresponding to the determined number of measures is inputted. Therefore, like the above-mentioned conventional automatic accompaniment apparatus, there is a problem in that the automatic accompaniment becomes monotonous if the length of the accompaniment pattern to be produced is short. Also, the accompaniment full of variety can be realized if the number of measures of the accompaniment pattern increases.

However, there is a problem in that the quantity of the automatic accompaniment data increases so that the large capacity of memory becomes necessary, resulting in cost up.

For purpose of solving the problem, an automatic accompaniment apparatus of an electronic musical instrument is disclosed in Japan Laid Open Patent Disclosure (JP-A-Showa 61-158400) in which an accompaniment pattern is changed to avoid monotonous accompaniment. According to the automatic accompaniment apparatus of this electronic musical instrument, a plurality of built-in patterns each having a predetermined length, e.g., one measure are provided and the order in which the plurality of patterns are used is specified by pattern specification information. Thereby, a long accompaniment pattern can be realized by use of a small capacity of memory, and the accompaniment full of variety is made possible.

However, in the automatic accompaniment apparatus of the electronic musical instrument disclosed in the above-mentioned reference (JP-A-Showa 61-158400), because execution order of the plurality of accompaniment patterns is determined based on the pattern specification information, it is necessary to specify the execution order of the accompaniment patterns. This specification is troublesome.

SUMMARY OF THE INVENTION

The present invention is made to solve such problems and has, as an object, to provide an automatic accompaniment apparatus and automatic accompaniment method in which the automatic accompaniment can be performed by use of a small capacity of memory to be full of variety and the automatic accompaniment can be performed while changing an accompaniment pattern in accordance with performance or operation by a user.

In order to achieve an aspect of the present invention, an automatic accompaniment apparatus includes a storage section for storing a plurality of accompaniment patterns, each of which corresponds to an automatic accompaniment data, a selecting section for selecting one of the plurality of accompaniment patterns based on an input specifying data, and selecting one of the plurality of accompaniment data corresponding to the selected accompaniment pattern, and an accompaniment sound signal generating section for generating an accompaniment sound signal based on the selected automatic accompaniment data by the selecting section.

In order to achieve another aspect of the present invention, a method of performing automatic accompaniment includes the steps of:

selecting one of a plurality of accompaniment patterns which are stored in a storage section, based on an input specifying data;

selecting one of a plurality of accompaniment data corresponding to the selected accompaniment pattern, each of the plurality of accompaniment data corresponding to one accompaniment pattern; and generating an accompaniment sound signal based on the selected automatic accompaniment data.

The selection of one of a plurality of accompaniment patterns includes referring to a table based on a specifying data to select the accompaniment pattern relating to the specifying data. The table storing a relating information for relating the specifying data to the selected accompaniment pattern. The specifying data may be a data indicative of chord type, and the table stores the relating information relating to the chord type data and the accompaniment pattern. In this case, when at least one of a plurality of keys of a keyboard unit is operated by a user, a keyboard data based on the at least one operated key is generated, and the chord type from the keyboard data is detected to generate the specifying data. The specifying data may be a data indicative of a number of notes, and the table stores the relating information relating to the number-of-notes data and the accompaniment pattern. In this case, when at least one of a plurality of keys of a keyboard unit is operated by a user, a keyboard data based on the at least one operated key is generated and the number of notes from the keyboard data is detected to generate the specifying data. Alternatively, the specifying data may be a data indicative of a rest length, and the table stores the relating information relating to the rest length data and the accompaniment pattern. In this case, when at least one of a plurality of keys of a keyboard unit is operated by a user, a keyboard data based on the at least one operated key is detected and the rest length from the keyboard data is detected to generate the specifying data.

When a panel having a plurality of operation elements is operated, a panel data in response to the operation of the panel is generated and a new accompaniment pattern from at least two of the plurality of accompaniment patterns is generated based on the panel data. Another automatic accompaniment data may be received to generate and store in the storage section another accompaniment pattern related to the other received automatic accompaniment data. When the panel having a plurality of operation elements is operated, a panel data is generated in response to the operation of the panel and the table is generated based on the panel data.

BRIEF DESCRIPTION OF THE DRAWINGS

FIG. 4 is a diagram of the structural example of a table stored in a table data memory in the first embodiment of the present invention;

FIG. 14 is a diagram of the structural example of a table stored in a table data memory which is used in the second embodiment of the present invention;

FIG. 20 is a diagram of the structural example of a table stored in a table data memory which is used in the third embodiment of the present invention;

DESCRIPTION OF THE PREFERRED EMBODIMENTS

The automatic accompaniment apparatus of the present invention will be described below in detail with reference to the accompanying drawings.

Figure 1A:
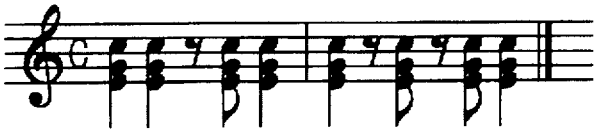
Fig. 1A PRIOR ART
FIGS. 1A and 1B are music scores illustrating an example of change of an accompaniment pattern when automatic accompaniment is performed by a conventional automatic accompaniment apparatus.
Figure 1B:
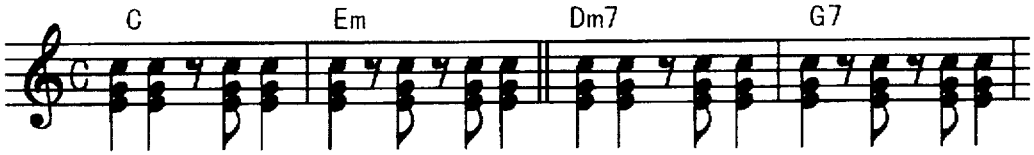
Fig. 1B PRIOR ART
Figure 2:
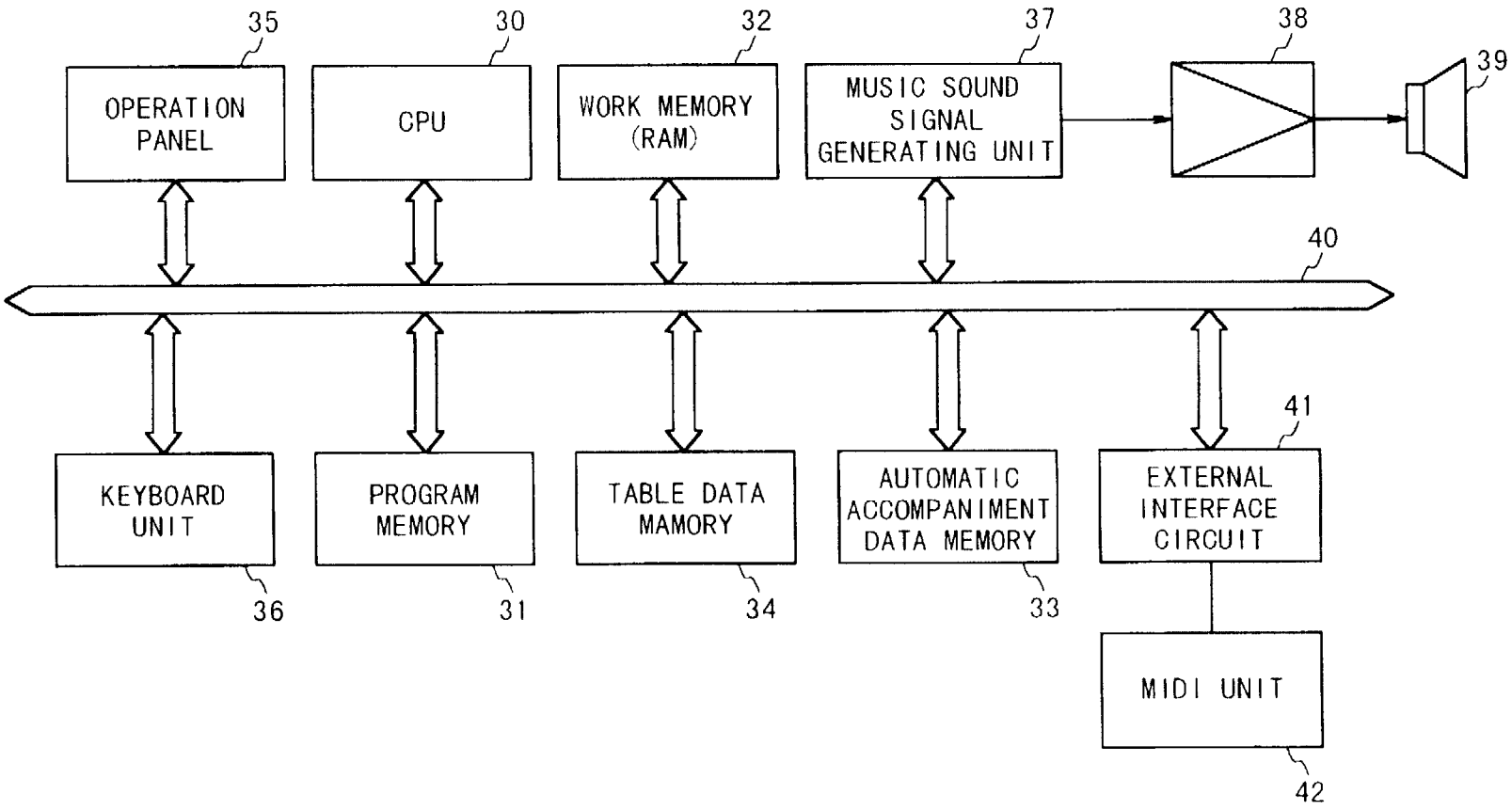
FIG. 2 is a block diagram illustrating the structure of an automatic accompaniment apparatus of the present invention.

FIG. 2 is a block diagram illustrating the hardware structure of the automatic accompaniment apparatus of the present invention. The automatic accompaniment apparatus is composed of a CPU 30, a program memory 31, a work memory 32, an automatic accompaniment data memory 33, a table data memory 34, an operation panel 35, a keyboard unit 36, a musical sound signal generating unit 37, and an external interface circuit 41, all of which are connected to a system bus 40. The external interface circuit 41 is connected to a MIDI unit 42. The system bus 40 is composed of a bus line to transmit and receive, for example, an address signal, a data signal or a control signal.

The CPU 30 controls the operation of the whole automatic accompaniment apparatus in accordance with a control program which is stored in the program memory 31. The detail of the processing executed by the CPU will be described later. Also, a timer (not illustrated) is connected to the CPU 30 and generates an interrupt signal for every predetermined time interval. The interrupt signal generated by the timer is supplied to the CPU 30 and used to proceed the automatic accompaniment in accordance with a tempo.

Further, the external interface circuit 41 is connected to the CPU 30. The external interface circuit 41 controls the transmission and reception of data between the automatic accompaniment apparatus and the external system such as a MIDI unit 42. As the external interface circuit 41, there may be used general interface circuits such as an MIDI interface circuit, an RS232C interface circuit and a SCSI interface circuit or various interface circuits having unique standard, depending on the kinds of units to which is external connected. For example, as the external system 42, there are another electronic musical instrument, a personal computer, a sequencer and so on. The external interface circuit 41 receives the data transmitted from the external system 42 to transmit to the CPU 30. The CPU 30 deals with the received data for chord detection, note count detection and rest length detection as "key pushing data". Also, the CPU 30 executes sound generation/extinguishment processing based on the data and further changes the setting state of the operation panel 35. On the contrary, the data which is generated when the operation panel 35 and keyboard unit 36 were operated is transmitted to the external system 42 through the external interface circuit 41. Thereby, it is made possible to control the external system 42 by the operation panel 35 and the keyboard unit 36 of the automatic accompaniment apparatus. It is supposed in the following description that the MIDI interface circuit is used as the external interface circuit 41.

The program memory 31 is composed of, for example, a read only memory (to be referred to as a "ROM" hereinafter). In addition to the control program described above, various type of data which is used by the CPU 30 is stored in the program memory 31. Also, a plurality of timbre parameters to specify the timbres corresponding to a plurality of range of a plurality of musical instrument sounds are stored in the program memory 31. One timbre parameter is used to define a timbre of a predetermined range of a predetermined musical instrument sound. Each timbre parameter is composed of, for example, a wave form address, a frequency data, an envelope data, a filter coefficient and so on. The program memory 31 may be composed of a RAM. In this case, the automatic accompaniment apparatus is structured such that the above control program, the predetermined data and timbre parameters are loaded in the program memory (RAM) before execution of the automatic accompaniment apparatus.

The work memory 32 is used to temporarily store various data when the CPU 30 executes various types of processing. Various registers, counters and flags for controlling the automatic accompaniment apparatus are defined in the work memory 32. Major ones of the registers, counters and flags will described below. The registers, counters and flags other than the major ones will be described when they appear.

(1) An automatic accompaniment flag: is a flag for storing whether the automatic accompaniment apparatus is in the automatic accompaniment mode or is in a normal performance mode.

(2) An address register: is a register for holding an address (a read address) of the automatic accompaniment data memory 33 or the work memory 32 in which the automatic accompaniment data currently processed is stored.

(3) A clock counter: is the counter which is incremented in synchronous with the timer interrupt generated from the timer for every predetermined time period.

(4) A read timing counter: is the counter which is incremented a time interval determined in accordance with a tempo set at that time, i.e., the time period corresponding to one step time. Here, one step time indicates a time interval corresponding to, for example, 1/24, 1/48, or 1/96 of one beat and is peculiar to the automatic accompaniment apparatus. In the following description, in the 1 step time, the description will be given as one step time is 1/24 of one beat. The absolute time of the one step time is determined based on the tempo. When the content of the read timing counter is changed, it is recognized as a check timing, i.e., a timing whether or not the current timing is a sound generating timing.

(5) A step time counter: is the counter which manages the progress of the automatic accompaniment, and which is cleared to zero at the head of even numbered measures and thereafter incremented for one step time.

(6) A synthetic accompaniment pattern buffer: is the buffer which stores a synthetic accompaniment pattern which has been produced by synthesizing a plurality of accompaniment sub-patterns.

The operation panel 35 is provided with various switches for controlling the automatic accompaniment apparatus such as an automatic accompaniment switch, a rhythm selection switch, a timbre selection switch, an acoustics effect specification switch, a volume switch and so on. Also, the operation panel 35 is provided with LCD displays each of which displays the setting state of each switch and an LED indicators which indicate a message used for a user to converse with the automatic accompaniment apparatus. Of the above-mentioned various switches, the major switches will be briefly described below.

An automatic accompaniment switch is used to control the start or stop of automatic accompaniment by the user. An automatic accompaniment switch is composed of, for example, a push button switch. The setting state of the automatic accompaniment switch is stored as the automatic accompaniment flag described above. The automatic accompaniment flag is toggled each time the automatic accompaniment switch is pushed. That is, the automatic accompaniment flag is set to "1" and automatic accompaniment is started, when the automatic accompaniment switch is pushed after automatic accompaniment is stopped (in the state of automatic accompaniment flag=0). On the other hand, when the automatic accompaniment switch is pushed after the automatic accompaniment is started (in the state of automatic accompaniment flag=1), the automatic accompaniment flag is cleared to "0" and the automatic accompaniment is stopped. The operation will be described below in detail.

The rhythm selector switch is used to select a desired one from among a plurality of rhythms. An accompaniment pattern of the automatic accompaniment is determined based on the rhythm selected by the rhythm selector switch. The rhythm selection switch is composed of, for example, a plurality of push button switches. A rhythm number allocated to the rhythm which has been selected by the rhythm selector switch is stored in the rhythm number register which is provided in the work memory 32. The panel interface circuit (not illustrating) is included in the operation panel 35. The panel interface circuit scans each of the switches on the operation panel 35 in accordance with an instruction from the CPU 30. The panel interface circuit produces a panel data in which one bit corresponds to each switch, based on a signal which indicates the open/close state of the switch on the operation panel 35 and which is obtained through the scanning. Each bit indicates an off state by "0", and an on state by "1". The panel data is sent to the CPU 30 through the system bus 40. The panel data is used to determine whether an on event or an off event is generated with respect of each of the switches on the operation panel 35. The description of the determination will be given later in detail. Also, the panel interface circuit sends a display data which has been sent from the CPU 30, to the display on the operation panel 35. Thus, a message corresponding to character data sent from the CPU 30 is displayed on the LCD display and the LED indicators (not illustrated) are also turned on/off.

The keyboard unit 36 is composed of a plurality of keys. The keyboard unit 36 is used to instruct sound generation in response to key pushing and sound extinguishment in response to key releasing in a normal performance mode. On the other hand, in an automatic accompaniment mode, the keys of the keyboard unit 26 are functionally classified into two portions. The keys on the lower side of a predetermined point (to be referred to as a "split point" hereinafter) are referred to as a lower key portion and the keys on the upper side of the split point are referred to as an upper key porion. The split point is predetermined. The lower key portion is a portion used as an object of chord detection and is used to specify a chord by the user. The upper key portion is used to instruct a sound generation/extinguishment, like the case of the above-mentioned normal performance mode. As the keyboard unit 36 are used a keyboard unit of 2-contact system in which each of the keys is provided with first and second key switches which are turned on in different pushing depths.

A keyboard interface circuit (not illustrated) is included in the above-mentioned keyboard unit 36. The keyboard interface circuit scans the key switches of the keyboard unit 36 in response to an instruction from the CPU 30. A keyboard data is produced based on a signal which indicates the open/close state of each key switch which is obtained from this scanning. The keyboard data is composed of a string of bits in which each bit corresponds to one key and, for example, each bit indicates the key pushed state by "1" and the key released state by "0". In this case, the keyboard interface circuit can be constructed such that the data of "1" indicative of the key pushed state is generated when, for example, both of the first and second key switches are turned on, and the data of "0" indicative of the key released state is generated, otherwise. Also, the time period from when the first key switch is turned on to when the second key switch is turned on is measured and a velocity data is generated based on the measured time period.

These keyboard data and velocity data are sent to the CPU 30 through the system bus 40. The CPU 30 determines based on the keyboard data whether or not any keyboard event is generated. The detail of the operation will be described later.

Figure 3:
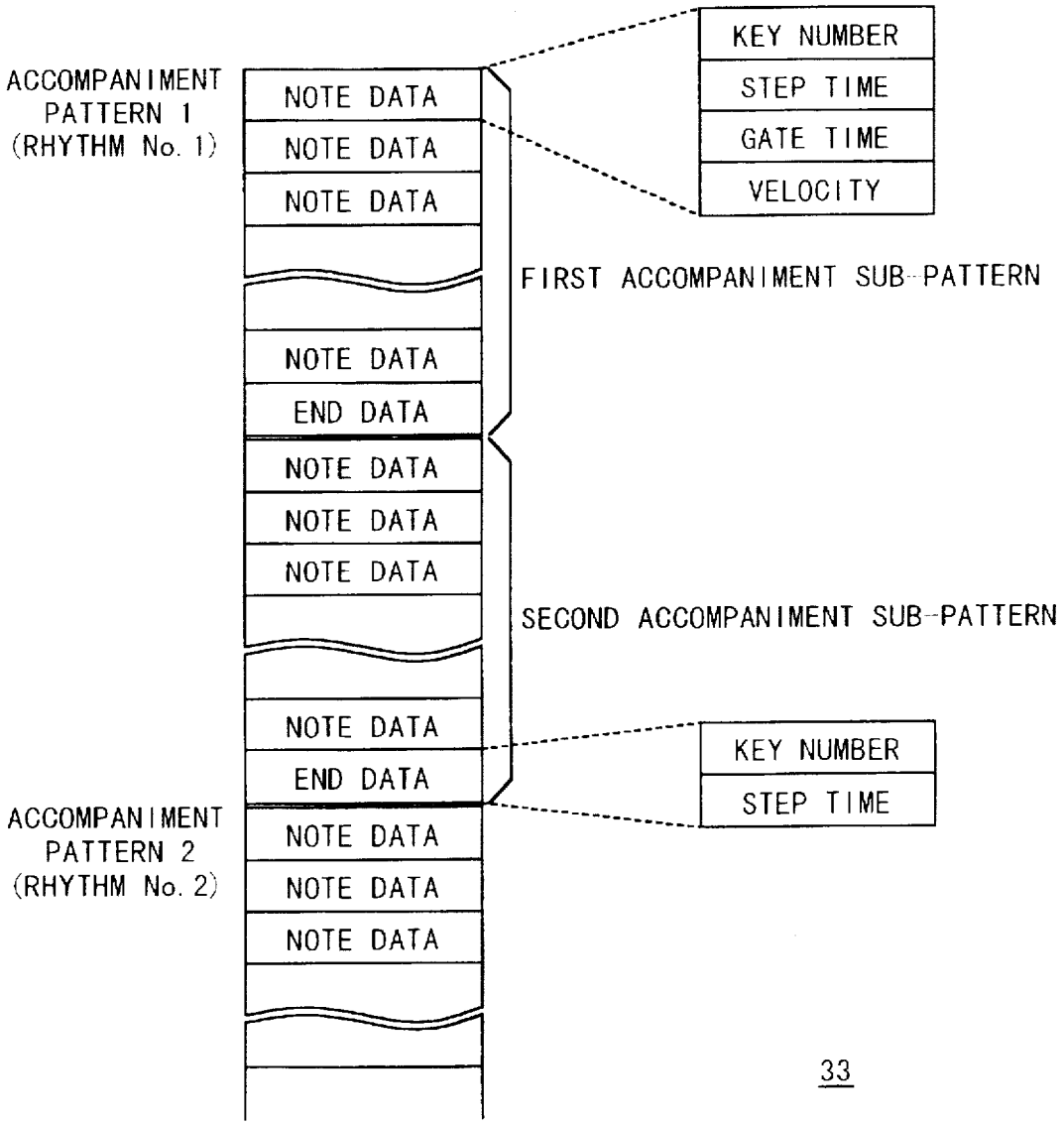
FIG. 3 is a diagram illustrating an example of automatic accompaniment data which is stored in an automatic accompaniment data memory and which is used in common between the first to third embodiments of the present invention.
Figure 5:
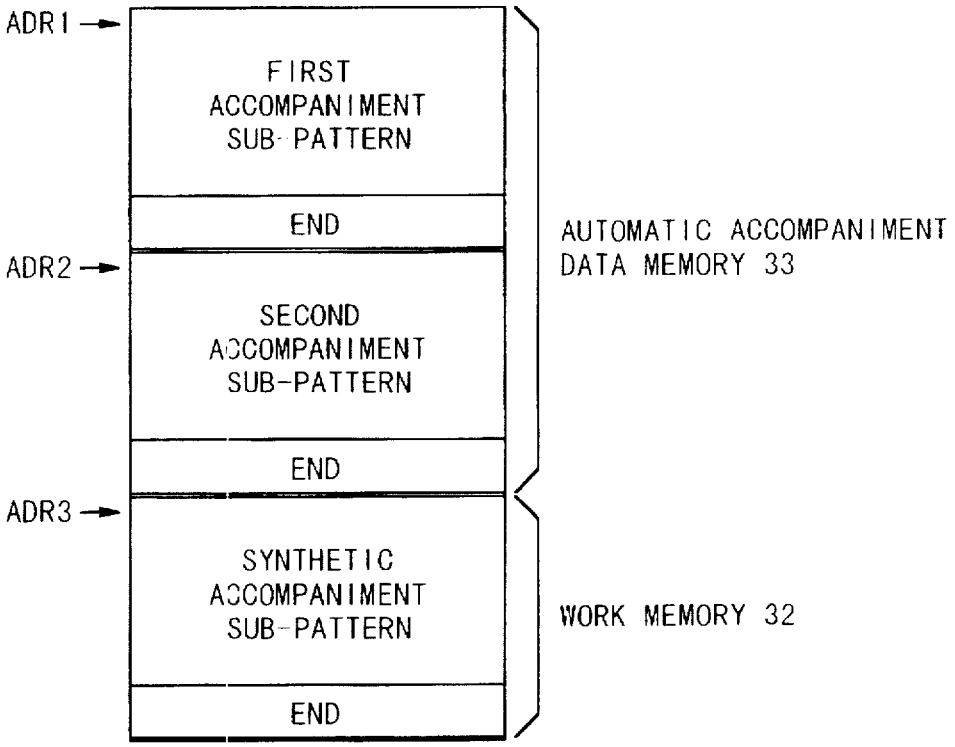
FIG. 5 is a diagram for explaining an accompaniment pattern which is selected during automatic accompaniment in the first embodiment of the present invention.
Figure 11A:
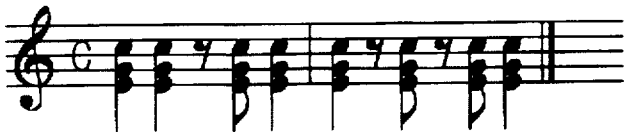
FIGS. 11A to 11C are musical scores illustrating an example of accompaniment patterns which are used in the first embodiment of the present invention.
Figure 11B:
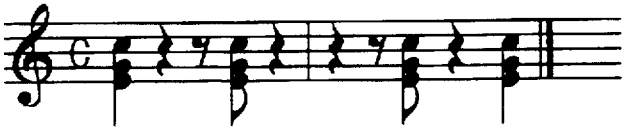
Figure 11C:
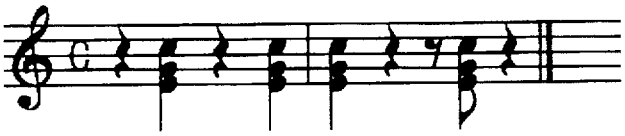

An automatic accompaniment data memory 33 is composed of a ROM. The automatic accompaniment data which corresponds to a plurality of accompaniment patterns 1, 2, . . . is stored in the automatic accompaniment data memory 33, as shown in FIG. 3. One accompaniment pattern corresponds to one rhythm. Further, each accompaniment pattern is composed of a plurality of accompaniment sub-patterns. FIG. 3 shows an example in which "accompaniment pattern 1 (rhythm number 1)" corresponding to one rhythm is composed of "the first accompaniment sub-pattern" and "the second accompaniment sub-pattern". The automatic accompaniment data corresponding to each of the above accompaniment sub-patterns is composed of a set of data each of which is used to generate a sound (hereinafter, to be referred to as a "note data") and an END data indicative of the end of the automatic accompaniment data, as shown in FIG. 3, for example. Also, each accompaniment sub-pattern is constructed in such a manner that a predetermined rhythm pattern is formed based on the basic code C, as shown in FIGS. 11B and 11C. This basic code C is developed into the code component sound corresponding to the chord type specified by the keyboard unit 36 in the sound generation.

Each of the above note data is composed of a 1-byte key number, a 1-byte step time, a 1-byte gate time and a 1-byte velocity data. The END data is composed of a 1-byte key number and a 1-byte step time. The MSB of "the key number" is used to determine whether the concerned data is a note data or the END data. When the MSB is indicative of a note data, the following 7 bits are used as the key number. On the other hand, when the MSB is indicative of the END data, the following 7 bits are not used. The key number corresponds to a number allocated to each key of, for example, the keyboard unit 36 and is used to specify a sound height (the interval). "The step time" is used to specify the timing of the start of sound generation. "The gate time" is used to specify the sound length to be generated. "The velocity data" is used to specify the sound strength to be generated. The automatic accompaniment data corresponding to one accompaniment pattern is composed of note data and an END data which are arranged in order of the step times, in order to realize an accompaniment pattern as shown in, for example, FIGS. 11B and 11C.

The automatic accompaniment data memory 33 can be composed of a RAM, a ROM card, a RAM card, a floppy disk, or a CD-ROM. In a case where the floppy disk or CD-ROM is used as the automatic accompaniment data memory 33, it is desirable that the automatic accompaniment data which has been stored therein is once loaded in the work memory 32 and then is accessed.

The table data memory 34 is a table for storing a correspondence relation of the chord type, the number of notes and the rest length which is detected from the key pushing data, as shown in FIGS. 4, 14 and 20.

FIG. 4 shows an example of the content of the table data memory 34 which is used in the first embodiment to be mentioned later. Only the accompaniment pattern corresponding to one rhythm in the illustrated example is shown, but data with similar structure is stored in the table data memory 34 in correspondence to each rhythm. The read addresses ADR1 to ADR3 of the automatic accompaniment data corresponding to the accompaniment pattern to be performed when a predetermined chord is detected are stored in the table data memory 34. In the illustrated example, the read address ADR1 of the first accompaniment sub-pattern for chord type maj and min, the read address ADR2 of the second accompaniment sub-pattern for chord types m7 and 7th, and the read address ADR3 of the synthetic accompaniment pattern for the chord type except the above are stored, respectively. The synthetic accompaniment pattern is the accompaniment pattern which is produced by synthesizing the first sub-accompaniment pattern and the second sub-accompaniment pattern and is the accompaniment pattern which is the same as the above-mentioned original accompaniment pattern. The automatic accompaniment data corresponding to this synthetic accompaniment pattern is stored in the synthetic accompaniment pattern buffer of the work memory 32. This is common in the following description.

The musical sound signal generating unit 37 is composed of a plurality of oscillators. The musical sound signal generating unit 37 is not illustrated in detail but composed of a wave form memory, a wave form read circuit, an envelope generating circuit, a D/A converter and so on. The wave form memory is composed of, for example, a ROM and stores the wave form data corresponding to each timbre parameter. The wave form data can be produced by performing, for example, pulse code modulation (PCM) to the musical sound signal corresponding to the natural musical instrument sound. The wave form read circuit reads the wave form data from the wave form memory. The envelope generating circuit generates an envelope signal for adding an envelope to the wave form data read by the wave form read circuit.

When there is the key pushing of the keyboard unit 36, reception of a note on data from the external interface circuit 41, or read of a note data from the automatic accompaniment data memory 33, the CPU 30 allocates at least one oscillator for the sound generation and supplies a timbre parameter to the allocated oscillator. One of the oscillators to which the sound generation is allocated in the musical sound signal generating unit 37 starts the generation of the musical sound signal by receiving the timbre parameter. That is, the wave form data is sequentially read from the wave form memory 19 indicated by the wave form address of the timbre parameter with the rate determined in accordance with the frequency data of the timbre parameter, and the envelope specified by the envelope data of the timbre parameter is added to the wave form data such that a musical sound signal is generated. The musical sound signal generated by the musical sound signal generating unit 37 is sent to the sound system which is composed of, for example, an amplifier 38, a speaker 39 and so on. That is, the music sound signal is amplified by the amplifier 38 of the sound system and is sent to the speaker 39 which converts into an acoustic signal and outputted.

Figure 6:
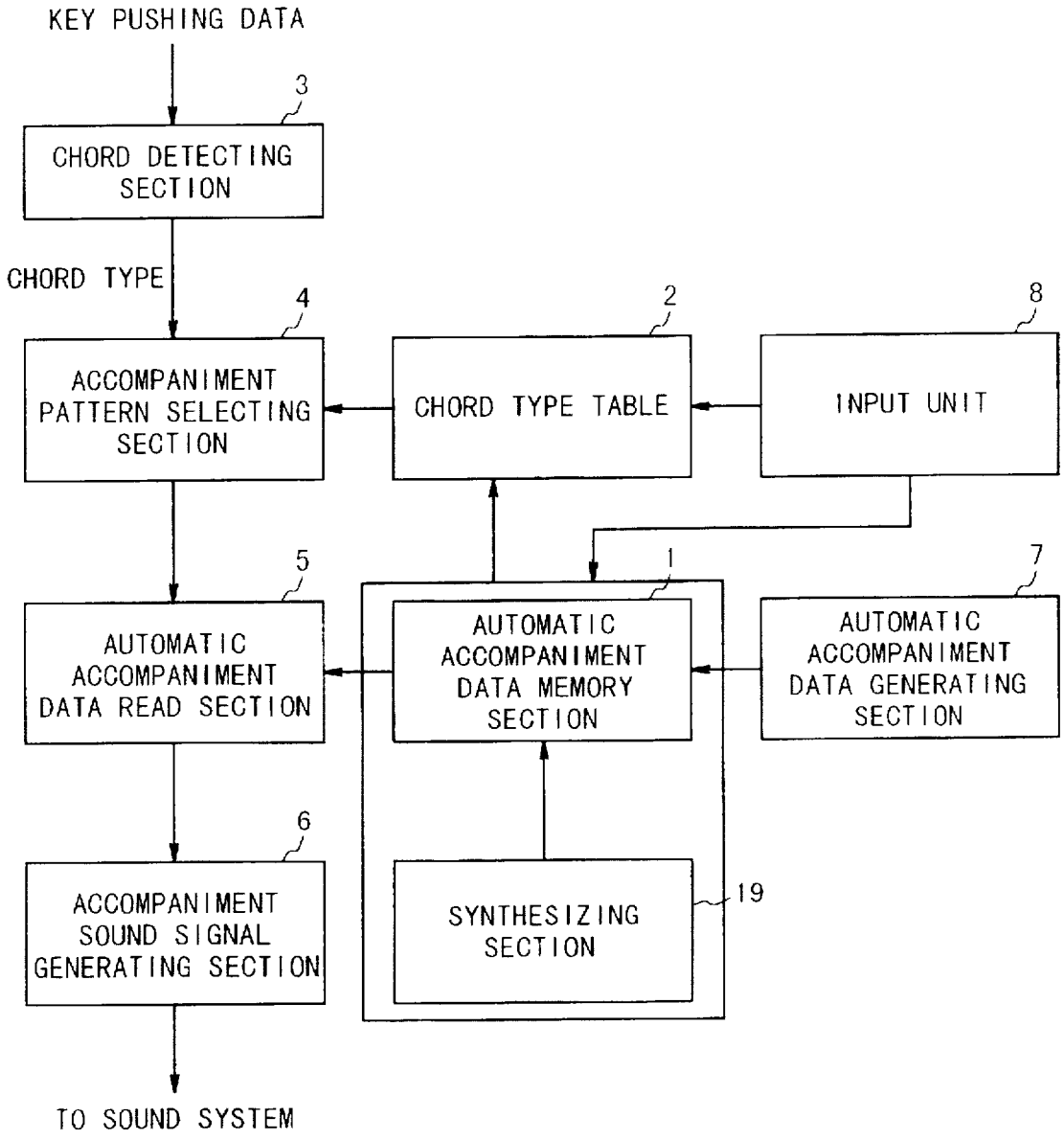
FIG. 6 is a functional block diagram illustrating the structure of the automatic accompaniment apparatus according to the first embodiment of the present invention.

Next, the functional structure of the automatic accompaniment apparatus according to the first embodiment of the present invention will be described with reference to FIG. 6. In FIG. 6, the automatic accompaniment apparatus is composed of an automatic accompaniment data memory section 1 for storing automatic accompaniment data corresponding to each of a plurality of accompaniment patterns, a chord type table 2 for storing relations between each of a plurality of chord types and one of a plurality of accompaniment patterns, a chord detecting section 3 for detecting a chord type, an accompaniment pattern selecting section 4 for referring to the chord type table 2 to select at least one accompaniment pattern related to the chord type detected by the chord detecting section 3, an automatic accompaniment data read section 5 for reading out an automatic accompaniment data corresponding to the accompaniment pattern selected by the selecting section 4 from the automatic accompaniment data memory section 1, and an accompaniment sound signal generating section 6 for generating an accompaniment sound signal based on the read automatic accompaniment data by the automatic accompaniment data read section 5. The automatic accompaniment apparatus may be composed of an automatic accompaniment data generating section 7 for generating a new automatic accompaniment data, a synthesizing section 19 for synthesizing a plurality of automatic accompaniment data stored in the memory section 1 into a new automatic accompaniment data and updating the chord type table based on the synthesis. Further, the automatic accompaniment apparatus may be composed of an input unit 8 for generating the chord type table 2, supplying a data for designating one of the plurality of automatic accompaniment data stored in the memory section 1 to the memory section 1. Each of the plurality of automatic accompaniment data is composed of data for generating an accompaniment pattern of one measure to a few measures and the data may include a data for generating drum sound, bass sound and so on in addition to data for generating the chord component sounds.

More particularly, one automatic accompaniment data which corresponds to a rhythm, corresponds to an original accompaniment pattern, i.e., an accompaniment pattern of a predetermined number of measures. The original accompaniment pattern is divided into a plurality of sub-patterns. Automatic accompaniment data corresponding to each of the sub-patterns may be stored in the memory section 1. For instance, the original accompaniment pattern of 2 measures corresponding to a rhythm as shown in FIG. 11A is divided into first and second accompaniment sub-patterns as shown in FIGS. 11B and 11C. The automatic accompaniment data corresponding to each of the first and second accompaniment sub-patterns is generated and stored in the memory section 1. In this case, the number of notes contained in the automatic accompaniment data corresponding to the original accompaniment pattern is equal to a summation of the number of notes contained in the automatic accompaniment data corresponding to the first accompaniment sub-pattern and the number of notes contained in the automatic accompaniment data corresponding to the second accompaniment sub-pattern. Therefore, even if the original accompaniment pattern is divided into the two sub-patterns, the quantity of the automatic accompaniment data is not increased.

In FIGS. 11A to 11C, a case that the original accompaniment pattern of 2 measures is divided into the two sub-patterns. However, the present invention is not limited to this. The original pattern and sub-pattern may have one measure or more than 2 measures. The number of divided sub-patterns is not limited to "2". 2 or more sub-patterns may be generated. In FIGS. 11A to 11C, the notes of the automatic accompaniment data corresponding to the original accompaniment pattern are divided equally. However, the notes may be divided in an arbitrary ratio.

The chord detecting section 3 may be composed of a CPU. The chord detecting section 3 detects a chord type based on a key pushing data. As the key pushing data, a keyboard data generated when the keyboard unit 36 is operated and a note on data contained in a MIDI message transmitted from the MIDI unit 42 may be used. As all the well known methods may be used for detection of the chord type in the chord detecting section 3.

Figure 12:
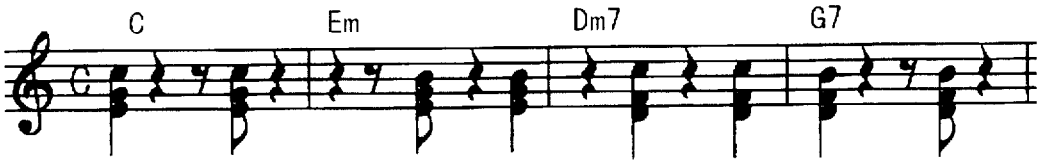
FIG. 12 is a musical score illustrating an example of change of the accompaniment pattern when the automatic accompaniment is performed by the automatic accompaniment apparatus according to the first embodiment of the present invention.

In the chord type table 2, in a case where chord types are related to accompaniment patterns, when chords are designated by the keyboard unit 36 in the order of C→Em→Dm7→G7, the first and second measures are performed based on the first accompaniment sub-pattern and the third and fourth measures are performed based on the second accompaniment sub-pattern, as shown in FIG. 12. Note that when a chord other than the above C, Em, Dm7 and G7 is designated, the automatic accompaniment is performed based on a synthetic accompaniment patter of the first and second accompaniment sub-patterns, i.e., the original accompaniment pattern. In this manner, the automatic accompaniment proceeds while the accompaniment pattern is changed depending upon a chord designated by a user. Therefore, the same accompaniment pattern is not always repeated and the automatic accompaniment full of variety can be achieved.

As the automatic accompaniment data generating section 7, the keyboard unit 36 which generating keyboard data, a MIDI interface circuit for externally receiving a MIDI message and so on may be used. As the input unit 8 the operation panel 35 which can input data may be used.

According to the above structure, the automatic accompaniment full of variety can be performed. Also, various accompaniment pattern can be always generated and stored in the memory section 1. Therefore, the freedom of automatic accompaniment can be extended.

Next, the operation of the automatic accompaniment apparatus according to the first embodiment will be described with reference to the flow charts shown in FIGS. 7 to 10 in the above structure. The operation shown in the above flow charts are realized by the processing of the CPU 30.

(1) The first embodiment

The automatic accompaniment apparatus according to the first embodiment of the present invention performs automatic accompaniment while changing an accompaniment pattern in accordance with a chord type which is specified by the keyboard unit 35.

(1a) The Main Processing Routine

Figure 7:
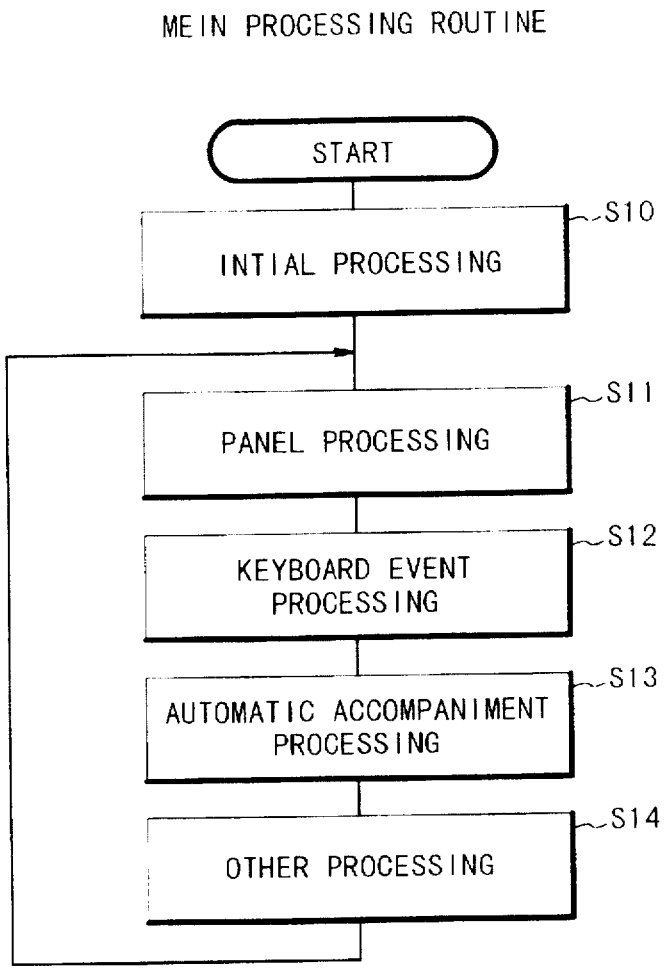
FIG. 7 is a flow chart illustrating a main processing routine which is used in the first embodiment of the present invention.

FIG. 7 is a flow chart illustrating a main processing routine of the automatic accompaniment apparatus. The main processing routine is started when power is turned on. In the main processing routine, initialization processing is first executed (step S10). In the initialization processing, the internal hardware of the CPU 30 is set to the initial state. Also, initial values are set to the registers, counters and flags which are defined in the work memory 32. Further, in the initialization processing, a predetermined data is sent to the musical sound signal generating unit 37 to prevent a sound from being unnecessarily generated when the power is turned on.

Next, when the initialization processing ends, panel processing is executed (step S11). In the panel processing, when various switches on the operation panel 35 are operated, the processing is executed which realizes the function of the switch operated in response to the operation. The detail of the panel processing will be described later.

Next, keyboard event processing is executed (step S12). In the keyboard event processing, a sound generation/extinguishment, chord detection processing and so on are executed in response to the operation of the keyboard unit 36. The detail of the keyboard event processing will are described later.

Next, automatic accompaniment processing is executed (step S13). In the automatic accompaniment processing, sound generation processing is executed based on the automatic accompaniment data. The detail of the automatic accompaniment processing will be also described later.

Next, "the other processing" is executed (step S14). In "the other processing", the processing other than the processing described above, e.g. the MIDI processing is executed. In the MIDI processing, various types of processing are executed based on the MIDI data which is received by the external interface circuit 41.

Thereafter, the control returns to the step S11 and the processing from the step S11 to the step S14 is repeated. In the process of the repeat execution, the switch event is generated in the operation panel 35 and the keyboard event is generated the keyboard unit 36. When data is received from the external interface circuit 41, the processing corresponding to the event is executed. Also, sound generation processing is executed based on the automatic accompaniment data. Thereby, various functions of the automatic accompaniment apparatus is realized.

On the other hand, timer interrupt processing is executed in parallel to the processing of the above-mentioned main processing routine. The timer interrupt processing is executed in response to the interrupt signal which is generated for every predetermined time period (e.g., several milliseconds) from a timer (not illustrated). The timer interrupt processing is not illustrated but the following processing is executed.

That is, in the timer interrupt processing, the contents of the clock counter are first incremented. Next, whether or not the content of the clock counter is equal to one step time is determined. At the time that the content of the clock counter is determined to be equal to the value corresponding to the step time, the content of the read timing counter is incremented. The content of the read timing counter is referred to in the automatic accompaniment processing to be described later, and is used to determine whether or not the above-mentioned checking timing has arrived. The checking timing is used as the timing when the gate time is to be decremented. On the other hand, if it is determined not to be equal to the value corresponding to one step time, the read timing counter is not incremented.

(1b) The Panel Processing Routine

Figure 8:
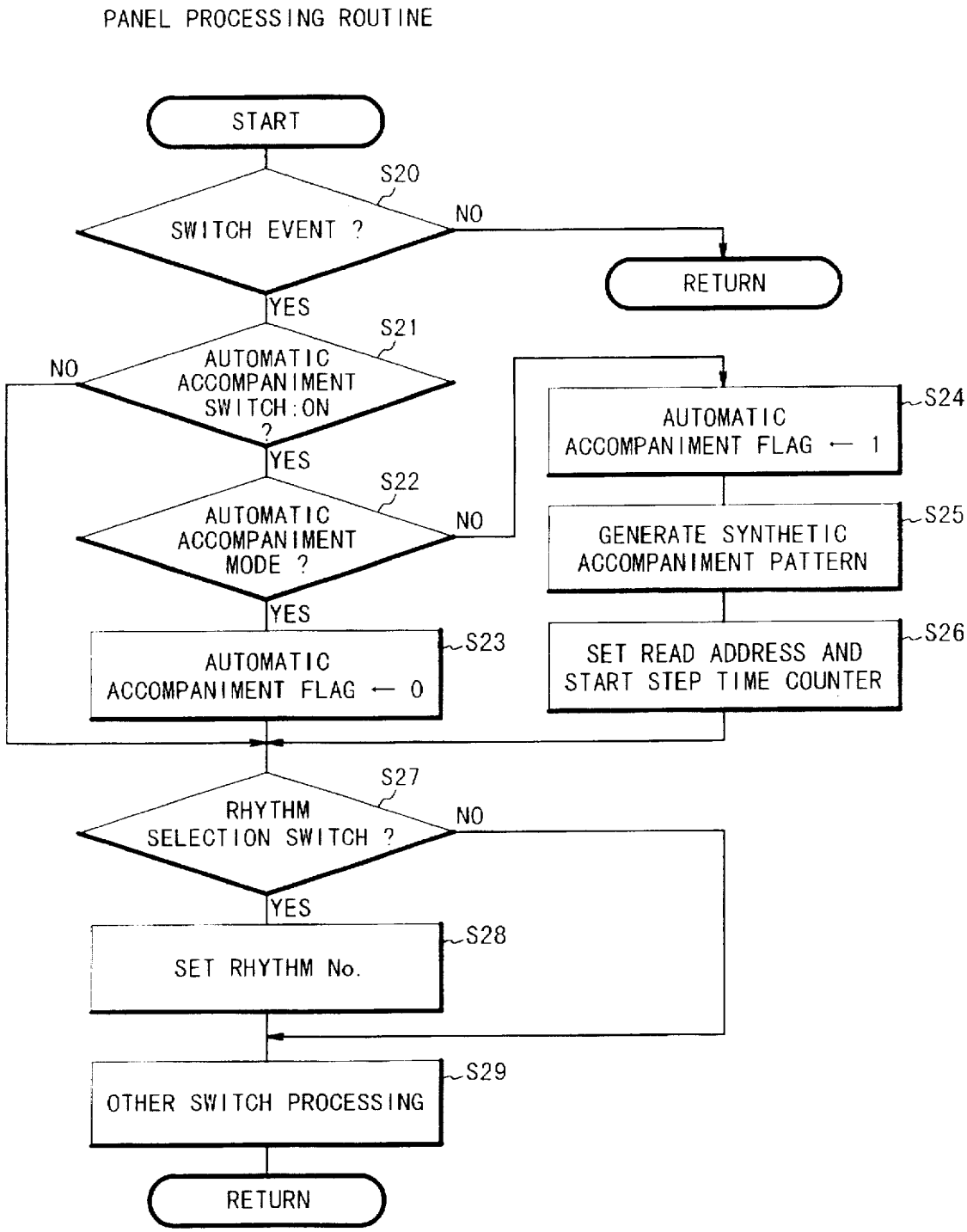
FIG. 8 is a flow chart illustrating a panel processing routine which is used in the first embodiment of the present invention.

The detail of the panel processing routine is shown in the flow chart of FIG. 8. The panel processing routine is called from the main processing routine for every substantially constant time period. The panel processing routines in the other embodiments which will be described below are the same.

In the panel processing, first, the presence or non-existence of a switch event is determined (step S20). That is, the CPU 30 reads a panel data (hereinafter, to be referred to as a "new panel data") from the operation panel 35 and stores in a new panel data register which is provided in the work memory 32.

Next, an exclusive logic summation of the new panel data and a panel data (hereinafter, to be referred to as an "old panel data") which is read in the last panel processing and then is stored in an old panel data register which is provided in the work memory 32 is computed to produce a panel event map. A switch event is determined not to have occurred if all the bits of the panel event map are zero and is determined to have occurred otherwise. If it is determined in step S20 that there is not a switch event, the control returns from the panel processing routine to the main processing routine. On the other hand, if it is determined that there is a switch event, whether or not there is an on event of the automatic accompaniment switch is determined (step S21). This is achieved by determining whether the bit corresponding to the automatic accompaniment switch is "1" in the panel event map and is the bit corresponding to the automatic accompaniment switch is "1" in the new panel data. If it is determined that the event is the on event of the automatic accompaniment switch, whether or not the mode is in an automatic accompaniment mode is determined (step S22). This is performed by determining the automatic accompaniment flag. This is the same in the following embodiments. If it is determined that the mode is in the automatic accompaniment mode, the automatic accompaniment flag is cleared to "0" (step S23). On the other hand, if it is determined that the mode is not the an automatic accompaniment mode, the automatic accompaniment flag is set to "1" (step S24). Through the processing of these steps S22 to S24, the toggle function is realized in which the automatic accompaniment mode and the normal performance mode are alternatively set every time the automatic accompaniment switch is pushed.

Next, an automatic accompaniment data which corresponds to the synthetic accompaniment pattern is produced (step S25). That is, each of the automatic accompaniment data of the first and second accompaniment sub-patterns corresponding to the rhythm number which has been set in the rhythm number register at that time is read from the automatic accompaniment data memory 33. Then, these automatic accompaniment data are rearranged in the order of the step times such that an automatic accompaniment data corresponding to the synthetic accompaniment pattern of 2 measures is produced. The automatic accompaniment data for the synthetic accompaniment pattern produced thus is stored in the work memory 32 specified by the address ADR3 and is used in the later-mentioned automatic accompaniment processing. In the automatic accompaniment processing in the first embodiment, as the accompaniment pattern to be automatically accompanied one of the first accompaniment sub-pattern specified by the address ADR1, the second accompaniment sub-pattern specified by the address ADR2 and the synthetic accompaniment pattern specified by the address ADR3 is selected in accordance with the detected chord type, as shown in FIGS. 11A to 11C.

Next, the read address ADR1 is set in the address register and the count up of the step time counter is started at the same time (step S26). Thereby, before a chord type is first detected, automatic accompaniment is performed based on the first accompaniment sub-pattern. If it is determined in the above-mentioned step S21 that there is not the on event of the automatic accompaniment switch, the control branches to a step S27.

Next, whether or not the on event is either one of the plurality of rhythm selector switches is determined (step S27). This is achieved by determining whether the bit corresponding to a predetermined rhythm selector switch is "1" in the panel event map and the bit corresponding to the rhythm selector switch is "1" in the new panel data. If it is determined that there is the on event of the rhythm selector switch, the rhythm number corresponding to the rhythm selector switch is set in the rhythm number register (step S28). The rhythm number is used to determine a read address, as mentioned above. If it is determined in the above-mentioned step S27 that there is not any event of the rhythm selector switch, the step S28 is skipped.

Next, "the other switch processing" is executed (step S29). In "the other switch processing", when it is determined that there is, for example, the event of the timbre selector switch, the timbre which has been set at that time is changed into the timbre corresponding to the timbre selector switch in which the on event occurred. In this manner, in the panel processing routine, the processing for realizing the function which is allocated to each switch on the operation panel 35 is executed.

Finally, the new panel data is moved to the old panel data register (not illustrated) and then the panel processing is ended.

(1c) The Keyboard Event Processing Routine

Figure 9:
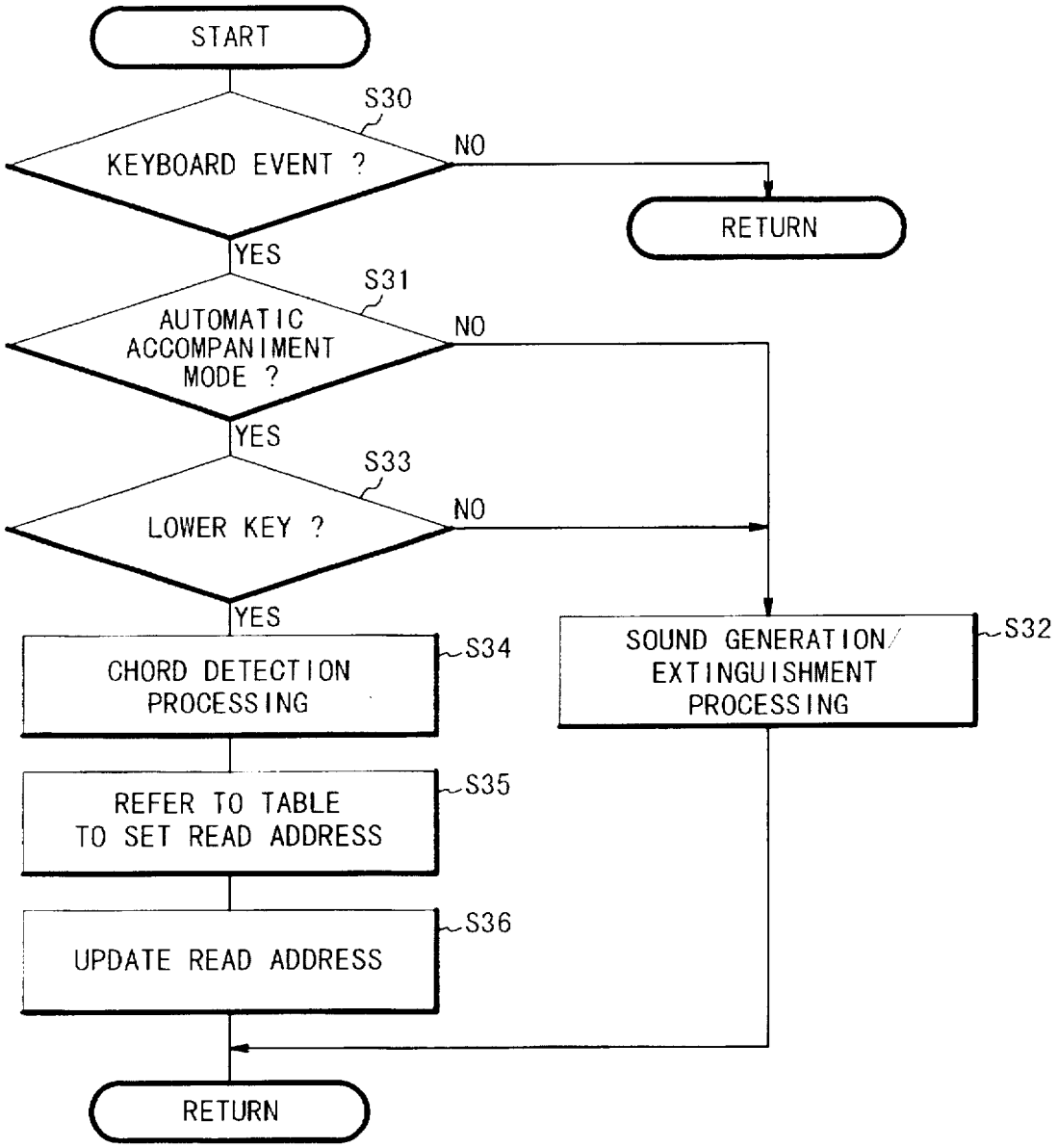
FIG. 9 is a flow chart illustrating a keyboard event processing routine which is used in the first embodiment of the present invention.

The detail of keyboard event processing is shown in the flow chart of FIG. 9. A keyboard event processing routine is called for every predetermined time period from the main processing routine. The keyboard event processing routines in other embodiments which will be explained below are same.

In the keyboard event processing, first, the presence or non-presence of the keyboard event is determined (step S30). That is, the CPU 30 reads a keyboard data (hereinafter, to be referred to as a "new keyboard data") from the keyboard unit 36 and stores in a new keyboard data register which is provided in the work memory 32. Next, an exclusive logic summation of the new keyboard data and a keyboard data (hereinafter, to be referred to as an "old keyboard data") which has been taken in by the keyboard event processing in the last time and which has been stored in the old keyboard data register provided in the work memory 32 is computed to produce a keyboard event map. If the bit of "1" is present in the event map, it is determined that the key event corresponding to the bit occurred, whereas, if it is not present, it is determined that any keyboard event does not have occurred. When it is determined in the step S30 that there is not a keyboard event, the control returns from the keyboard event processing routine to the main processing routine.

On the other hand, when it is determined that there is a keyboard event, whether or not the mode is an automatic accompaniment mode is determined (step S31). When it is determined that the mode is not an automatic accompaniment mode, normal sound generation/extinguishment are performed (step S32). In the normal sound generation/extinguishment processing, whether the keyboard event is a key pushing event or a key releasing event is first determined. This is achieved by determining a bit of the new keyboard data which corresponds to the bit of "1" of the keyboard event map. That is, if the corresponding bit of the new keyboard data is "1", it is determined that there is a key pushing event and key pushing event processing is executed. On the other hand, it is determined the keyboard event is the key releasing event if the corresponding bit is "0", and key releasing event processing is performed. This is the same in the following description.

In the key pushing event processing, a key number corresponding to the bit of "1" in keyboard event map is calculated and the velocity data corresponding to the key is read from the keyboard interface circuit. A timbre parameter corresponding to the key number is read from the program memory 31 and is sent to the musical sound signal generating unit 37 together with the velocity data. Thereby, a sound determined in accordance with the pushed key is generated from a speaker 39 in the strength determined in accordance with the key pushing.

In the key releasing event processing, a key number corresponding to the bit of "1" in the keyboard event map is calculated and an oscillator which is during sound generation and which corresponds to the key number is searched. At high speed attenuating envelope data is sent to the searched oscillator. Thereby, sound to be generated is extinguished in accordance with the key releasing.

On the other hand, when it is determined in the above-mentioned step S31 that the mode is an automatic accompaniment mode, whether the keyboard event is a lower key event is determined (step S33). This is achieved by calculating a key number corresponding to the bit of "1" in the keyboard event map and by determining whether or not the calculated key number is smaller than the data indicative of a split point. When it is determined that the key is not a lower key, i.e., it is an upper key, the control branches to step S32 such that the normal sound generation/extinguishment is executed. Thereby, in the automatic accompaniment mode, it is possible to perform, for example, a melody using the upper key.

The chord detection processing is executed when it is determined that the key is a lower key in the above-mentioned step S33 (step S34). The chord detecting section 3 of the automatic accompaniment apparatus according to the first embodiment of the present invention is realized in the processing of the step S34. In the chord detection processing, a chord type and a chord route are detected in accordance with the key pushing form of the lower key. As the method of detecting a chord can be used any well-known method. The detected chord type is stored in the chord-type register which is provided in the work memory 32 and then used to execute chord development in a case of later-mentioned automatic accompaniment processing.

Next, the table is referred to and a read address is set in the address register (step S35). That is, either one of read addresses ADR1, ADR2 and ADR3 of the accompaniment patterns corresponding to the chord type which has been detected in the above step S34 is taken out from the table (see FIG. 4) stored in table data memory 34 and set in the address register. The accompaniment pattern selecting section 4 of the automatic accompaniment apparatus according to the first embodiment of the present invention is realized by the processing of this step S35.

When, for example, maj or a min is detected as the chord type, the head address ADR1 of the automatic accompaniment data corresponding to the first accompaniment sub-pattern is set in the address register. When m7 or 7th is detected as the chord type, the head address ADR2 of the automatic accompaniment data corresponding to the second accompaniment sub-pattern is set in the address register. When a chord other than the above chords is detected as the code type, the head address ADR3 of the automatic accompaniment data corresponding to the synthetic accompaniment pattern is set in the address register.

Next, the update of the read address is performed (step S36). When a chord is detected on the way of one accompaniment pattern (2 measures), it is necessary to change an accompaniment pattern thereafter. In order to cope with such a case, the processing is executed in which the read address is proceeded to the position at which automatic accompaniment is being performed at the point. That is, one of the note data is taken from the read address set in the above-mentioned step S35. The step time contained in the note data and the content of the step time counter at the point are compared. If the step time contained in the note data is smaller than the content of the step time counter, "4" is added to the read address and then the same processing is performed. When the step time contained in the note data becomes greater than the content of the step time counter, the above processing is stopped. The read address at the time is set in the address register and then the processing ends. Thereby, in a case where a chord is changed on the way of the automatic accompaniment, the automatic accompaniment can be smoothly switched over to the accompaniment pattern corresponding to the changed chord without disturbing the progress of the automatic accompaniment. When the above processing ends, the control returns from the keyboard event processing routine to the main processing routine.

(1d) The Automatic Accompaniment Processing Routine

Figure 10:
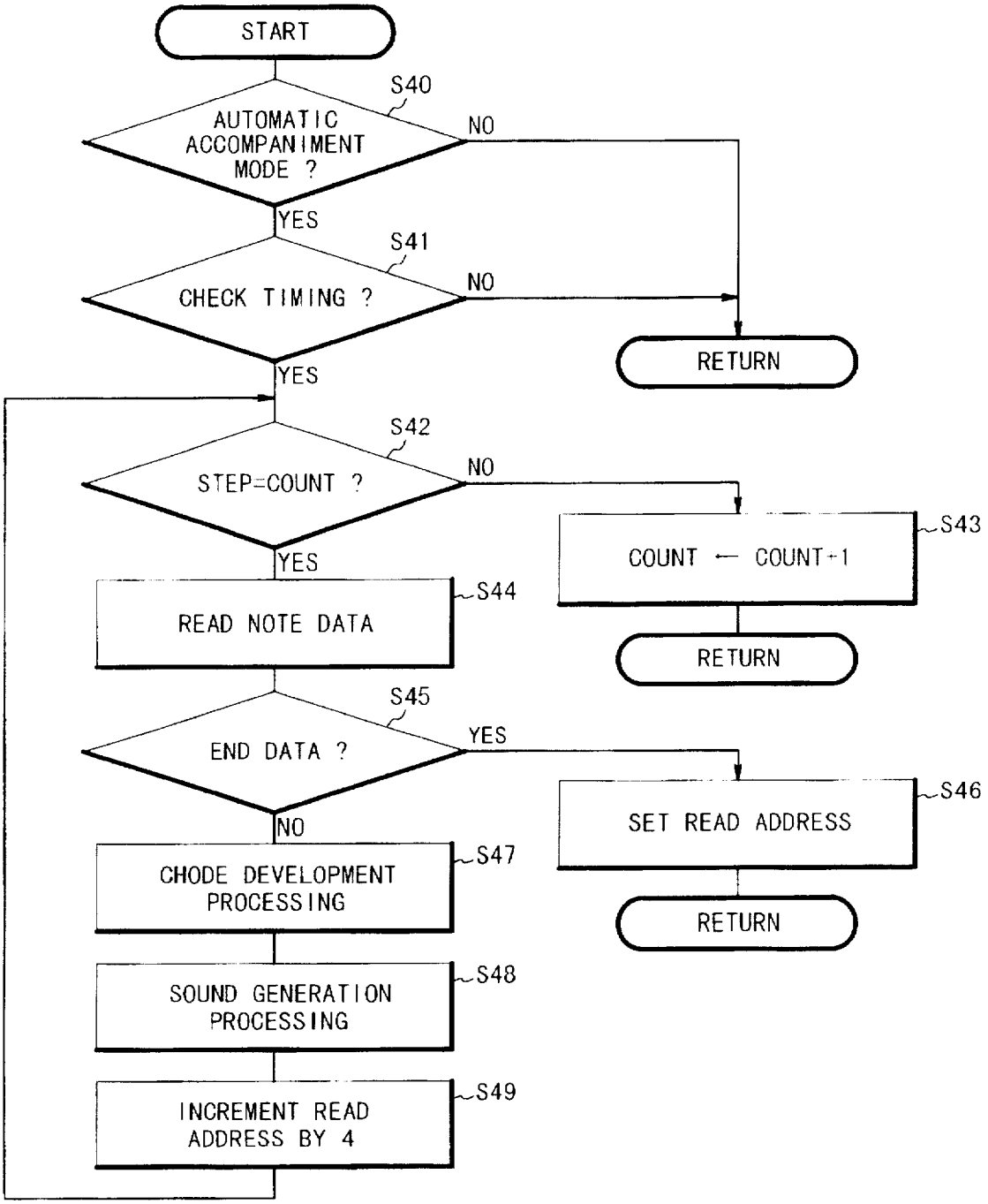
FIG. 10 is a flow chart illustrating an automatic accompaniment processing routine which is used in common in the first embodiment of the present invention.

FIG. 10 is a flow chart showing the detail of automatic accompaniment processing. An automatic accompaniment processing routine is called from the main processing routine for every predetermined period. This processing is the same in the automatic accompaniment processing routine of the other embodiment which will be explained below. In the automatic accompaniment processing, whether or not an automatic accompaniment mode is set first is determined (step S40). When it is determined that the current mode is not an automatic accompaniment mode, the control returns from the automatic accompaniment processing routine to the main processing routine. That is, the automatic accompaniment processing routine is called from the main processing routine for every predetermined period, and because the control returns immediately to the main processing routine if the automatic accompaniment mode is not set. In this manner, the function of stopping the automatic accompaniment is realized.

On the other hand, when it is determined that the mode is an automatic accompaniment mode, whether or not the current timing is checking timing is determined (step S41). This is achieved by determining whether or not the content of the read timing counter is changed from the value which has been determined in the automatic accompaniment processing in the last time. When it is determined that the timing is not the checking timing, it is determined that 1 step time does not have elapsed from the automatic accompaniment processing in the last time and the control returns from the automatic accompaniment processing routine to the main processing routine.

On the other hand, when it is determined that the current timing is the checking timing, a step time STEP in the note data or the END data which is specified by the read address which is held in the address register and the content COUNT of the step time counter are compared (step S42). When these are determined not to be coincident, data in which the step time STEP is contained is determined not to reach the execution timing and the content COUNT of the step time counter is incremented (step S43). Thereby, the function is realized that the content of the step time counter is incremented every step time. Thereafter, the control returns from the automatic accompaniment processing routine to the main processing routine.

When it is determined that the step time STEP and the content COUNT of the step time counter are coincident to each other as a result that the contents COUNT of the step time counter is incremented in this way, it is determined that the data in which the step time STEP is contained reaches the execution timing. As a result, the note data or the END data in which the step time STEP is contained is read from the automatic accompaniment data memory 33 (step S44) and whether or not the data is END data is determined (step S45). This is performed by determining the MSB of the first byte of the data. When it is determined the data is the END data here, it is recognized that the control reaches the end of the automatic accompaniment pattern. The head read address of the automatic accompaniment data corresponding to the accompaniment pattern which is currently executed is set in the address register (step S46). Thus, the function is achieved in which the automatic accompaniment is repeatedly performed based on the accompaniment pattern.

On the other hand, if it is determined in the above step S45 that the data is not the END data, the data is recognized to be a note data and chord development processing is performed (step S47). In the chord development processing, the note data which are stored in the automatic accompaniment data memory 33 in the form of the chord composition sounds of the basic chord C are changed into the chord composition sounds to be generated in accordance with the chord type (stored in the chord-type register of the work memory 32). For example, when the code Em is detected, the sounds "e" and "g" are not changed but the sound "c" is changed into "b".

Next, a sound generating processing is performed (step S48). In the sound generation processing, the timbre parameter corresponding to the key number in the note data is read from the program memory 31 and sent to the musical sound signal generating unit 37 together with the velocity data. Thereby, a sound is generated from the speaker 39 with the intensity which has been specified by the velocity in accordance with the note data.

Next, "4" is added to the read address for the next note data (step S49). Then, the control returns to the step S42 and the similar processing is repeated. Thus, sounds are generated based on all the note data having the same step time STEP. For instance, in the above-mentioned first and second accompaniment sub-pattern, because 3 sounds which form a chord have the same step time STEP, the processing of the steps S42 to S49 is repeated three times. As a result, 3 sounds are generated at the same time.

In the example explained above, it is supposed that the automatic accompaniment data is stored in advance in the automatic accompaniment data memory 33, and the information (specifically, a read address) relating a chord type and an accompaniment pattern is stored in advance in the table data memory 34. However, the apparatus may be composed such that automatic accompaniment is performed based on the automatic accompaniment data which has been produced by the user. In this case, the automatic accompaniment data memory 33 and the table data memory 34 are composed of RAMs.

Also, the keyboard unit 36 is used to generate the automatic accompaniment data which is stored in the automatic accompaniment data memory 33. Note data are produced from the keyboard data which have been generated by the operation of keyboard unit 36 and sequentially stored in the automatic accompaniment data memory 33. In the production of the note data, "a key number" can be produced based on the bit which indicates that there has been an event in the keyboard event map. As the velocity data, the velocity data which has been detected by the keyboard interface circuit at the time of the key pushing can be used just as it is. As the step time data, the content of the step time counter which starts operation at the same time as the recording (the storage) start is used.

Further, the gate time can be determined by calculating the difference between the content of the step time counter at the time of the key pushing and the content of the step time counter at the time of the key releasing of the concerned key. The processing which determines each of these data may be performed at the same time as the sound generation/extinguishment processing of the step S32 in the keyboard event processing routine (FIG. 9).

A MIDI interface circuit 41 may be used instead of the above keyboard unit 36. In this case, the note on data contained in a MIDI message which has been received by the MIDI interface circuit 41 can be used instead of the keyboard data generated by the keyboard unit 36.

Also, the table which relates a chord type and an accompaniment pattern can be produced by rewriting the content of the table data memory 34 using the operation element provided on the operation panel 35. For example, as the operation element, various switches such as an up down switch, a dial, a ten-key, the other switch can be used for inputting a numerical value.

As above mentioned, if the automatic accompaniment data is produced in the automatic accompaniment data memory 33 and the table for storing the information relating a chord type and an accompaniment pattern is produced in the table data memory 34, the automatic accompaniment apparatus can be realized by the same processing as described above while the accompaniment pattern changes in accordance with the specification of the chord type.

(2) The Second Embodiment

Figure 13:
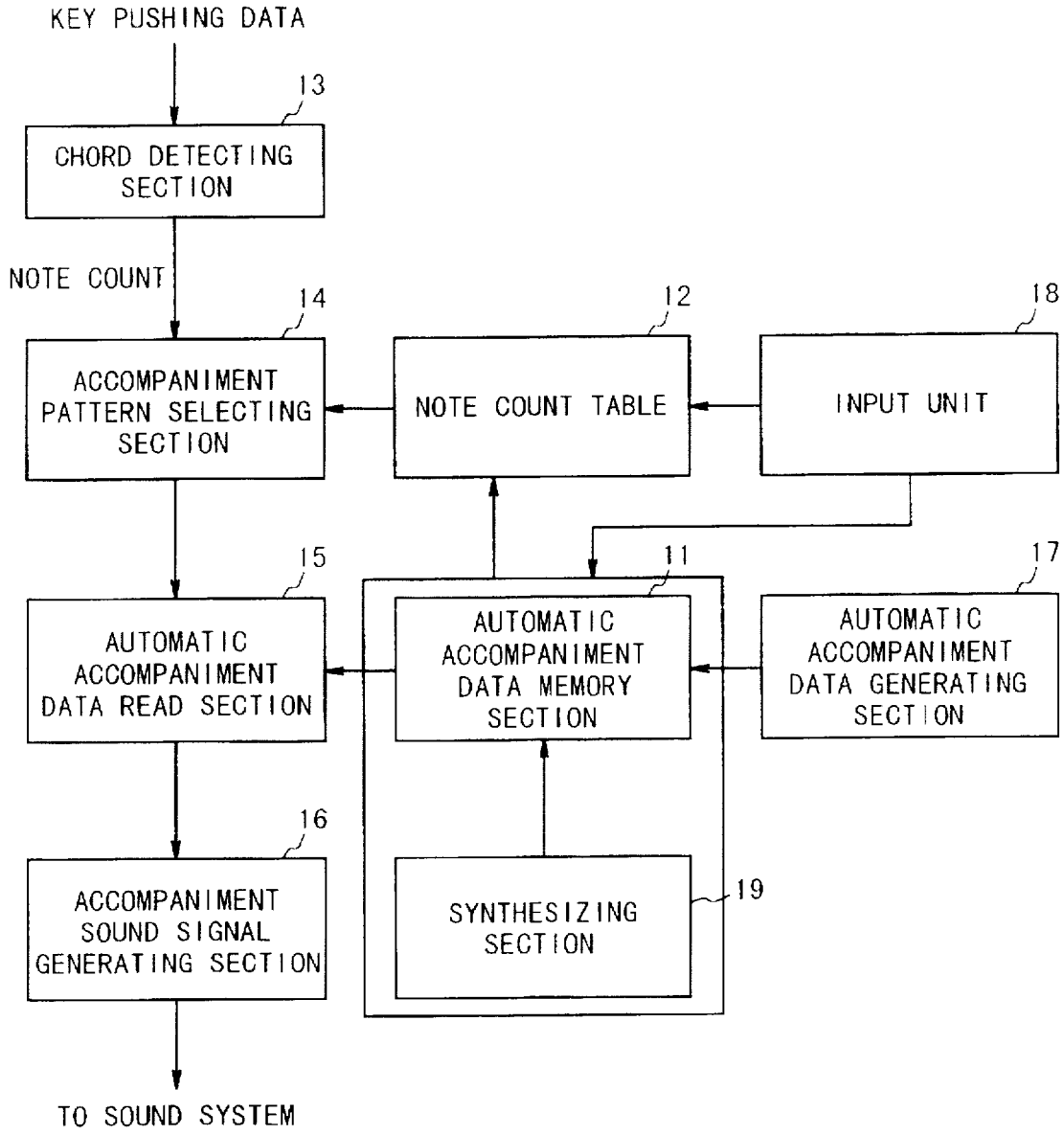
FIG. 13 is a functional block diagram illustrating the structure of the automatic accompaniment apparatus according to the second embodiment of the present invention.

Next, the automatic accompaniment apparatus according to the second embodiment of the present invention will be described. In the automatic accompaniment apparatus in the second embodiment, automatic accompaniment is performed while changing an accompaniment pattern in accordance with the number of notes which are generated through the operation of the keyboard unit 35. FIG. 13 is the functional block diagram illustrating the automatic accompaniment apparatus according to the second embodiment. In the second embodiment, a note count detecting section 13 is provided in place of the chord detecting section 3. Also, a note count table 12 is provided in place of the chord type table 2. The accompaniment pattern selecting section 14 refers to the note count table 12 based on the note count from the note count detecting section 13 to select an automatic accompaniment data to be read. Other structure is the same as in the first embodiment.

The automatic accompaniment apparatus according to the second embodiment of the present invention is the automatic accompaniment apparatus which performs automatic accompaniment while changing the accompaniment pattern in accordance with the number of the notes which has been generated by the operation of the keyboard unit 35. In the following description, when the number of notes is detected for every 2 beats, the subsequent 2 beats are performed based on the first accompaniment sub-pattern if the number of the notes in the 2 beats is less than four and the subsequent 2 beats are performed in the synthetic accompaniment pattern if the number of notes is equal to or more than four.

(2a) The Main Processing Routine

As the main processing routine in the second embodiment of the present invention, the routine which is used in the first embodiment and which is shown in the flow chart of FIG. 7 is used just as it is. Therefore, the description is omitted.

(2b) The Panel Processing Routine

Figure 16:
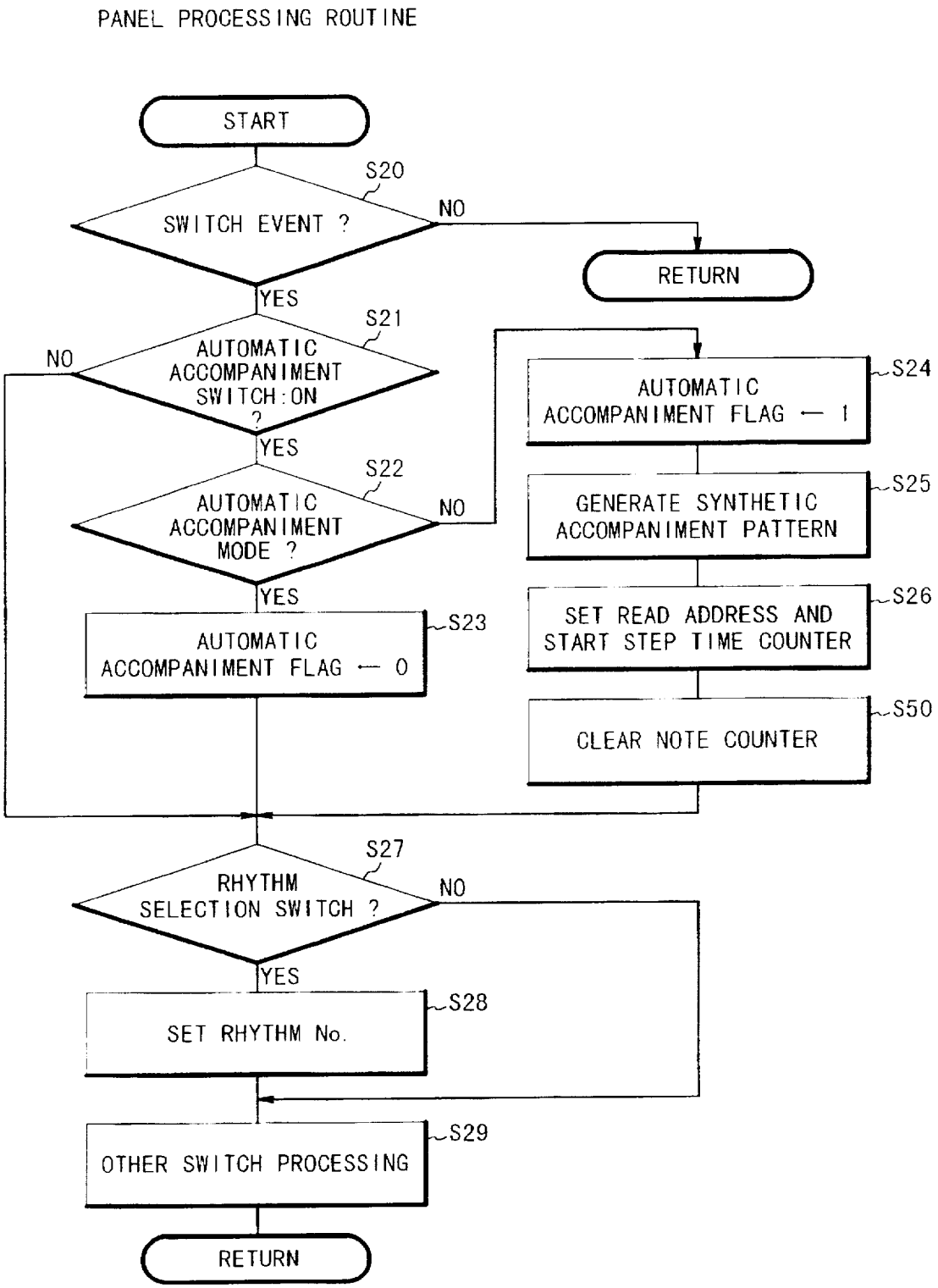
FIG. 16 is a flow chart illustrating a panel processing routine which is used in the second embodiment of the present invention.

The detail of the panel processing routine is shown in the flow chart of FIG. 16. The panel processing is different from the panel processing (FIG. 8) which is used in the first embodiment only in that the processing of step S50 is added. Therefore, the same reference numerals are allocated to the same portions and the description is omitted. In the following description, the different description will be described as a main matter.

Figure 15:
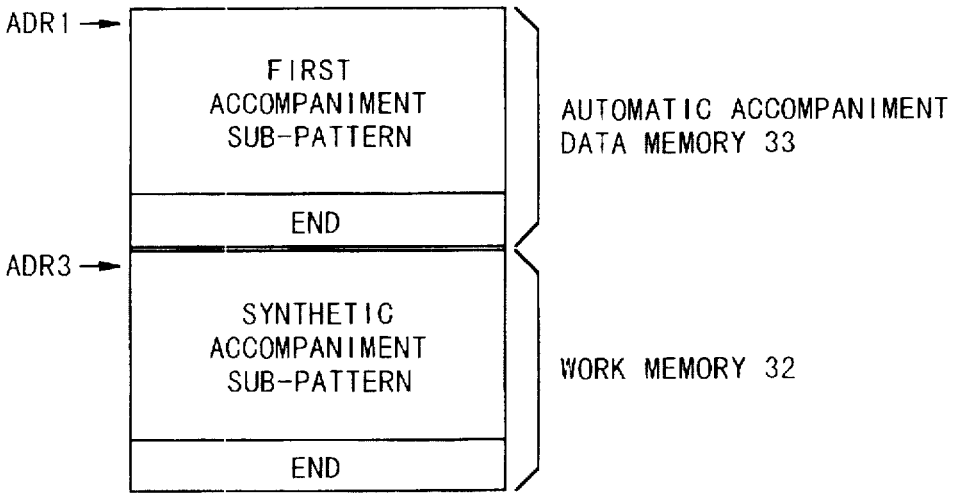
FIG. 15 is a diagram for explaining an accompaniment pattern which is selected during automatic accompaniment in the second embodiment of the present invention.
Figure 17:
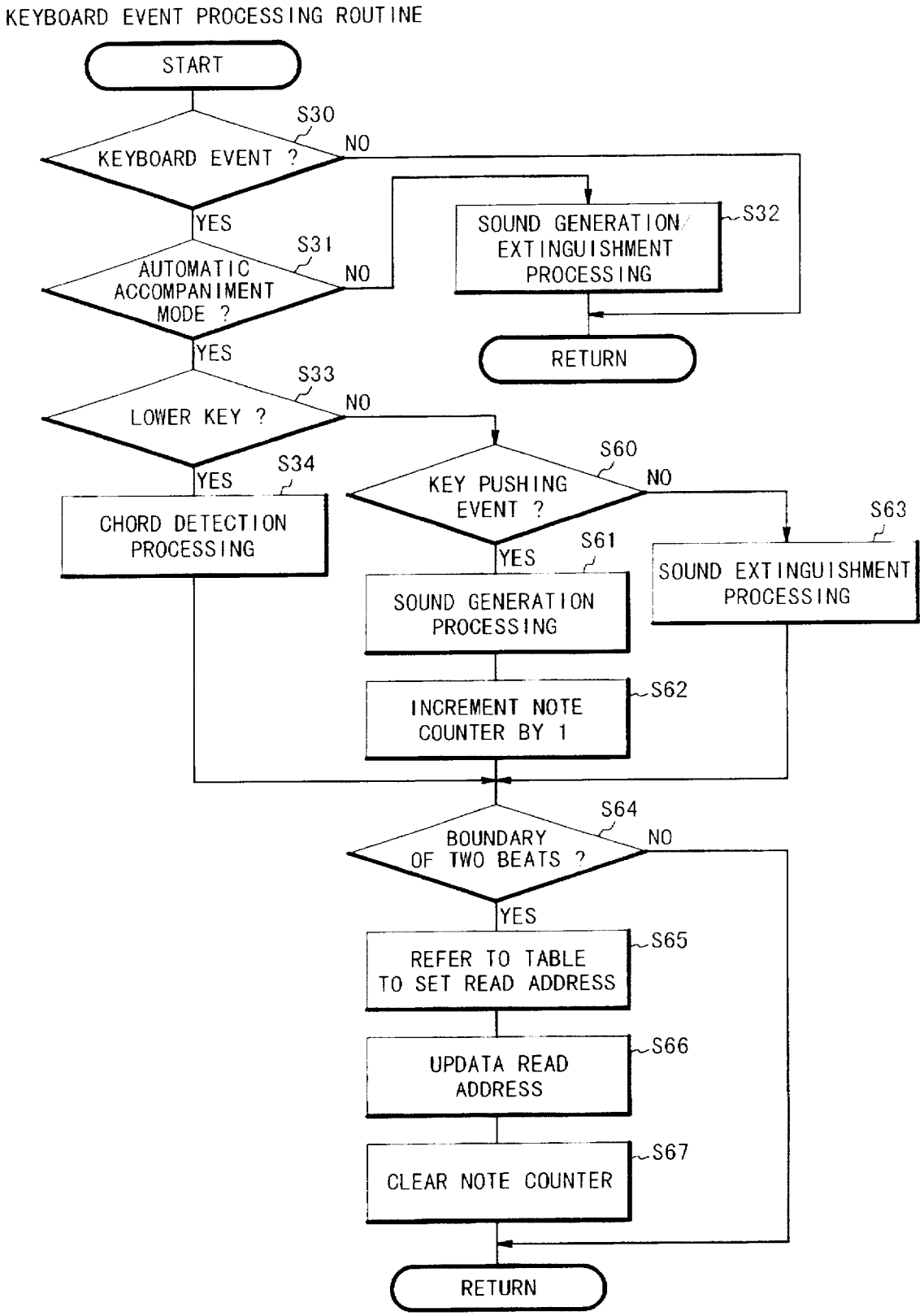
FIG. 17 is a flow chart illustrating a keyboard event processing routine which is used in the second embodiment of the present invention.

In the step S25 of FIG. 16, the automatic accompaniment data corresponding to the synthetic accompaniment pattern is generated in the same manner as in the case of the above-mentioned first embodiment. In the automatic accompaniment processing in the second embodiment, one of the first accompaniment sub-pattern indicated by the read address ADR1 and the synthetic accompaniment pattern indicated by the read address ADR3 is selected in accordance with the number of detected notes as the accompaniment pattern to be automatically accompanied, as shown in FIG. 15. In the step S26 of FIG. 16, the read address ADR1 is set in the address register and the step time counter starts to be counted up. Thereby, automatic accompaniment is performed based on the first accompaniment sub-pattern before the number of the notes is first detected, i.e., during 2 beats from the start of automatic accompaniment. In a step S50 which is added in the second embodiment, a note counter is cleared. Here, the note counter is the counter which is provided in the work memory 32 and is used to count the number of times of key pushing. By the step S50, the function is realized that the note counter is initialized at the time when the automatic accompaniment apparatus is set in the automatic accompaniment mode by the automatic accompaniment switch (2c) The Keyboard Event Processing Routine The detail of keyboard event processing is shown in the flow chart of FIG. 17. The keyboard processing includes the same portions as those of the keyboard processing routine (FIG. 9) used in the first embodiment. Therefore, the same reference numerals are assigned to the same portions and the portions will be simply described. The different portion will be mainly described.

The processing of the steps S30 to S34 in the keyboard event processing routine is the same as that of the processing in the above-mentioned first embodiment. In the second embodiment, when the chord detecting processing of the step S34 ends, the control goes to a step S64. When it is determined in the above step S33 that the key is not any one of lower keys, i.e., it is one of an upper keys, whether the keyboard event is a key pushing event or a key releasing event is determined (step S60). Here, if it is determined that the keyboard event is a key pushing event, the sound generation processing is executed (step S61). The sound generation processing is executed in the same manner as the key pushing event processing in the above-mentioned first embodiment.

Next, the note counter is incremented (step S62). That is, the note counter is incremented every time a sound generation is executed in accordance with the key pushing. The note count detecting means 13 of the automatic accompaniment apparatus according to the second embodiment of the present invention is realized by the processing of the step S62. Thereafter, the control advances to the step S64.

On the other hand, if it is determined in the above step S60 that the keyboard event is not a key pushing event, it is recognized that a key releasing event occurred, and the sound extinguishment processing is executed (step S63). The sound extinguishment processing is executed in the same manner as the key releasing event processing in the above-mentioned first embodiment. After that, the control advances to the step S64. Through these steps S60, S61 and S63, in the automatic accompaniment mode, melody performance can be made by use of the upper keys in the performance.

In the step S64 and the subsequent steps, in a case where the performance proceeds to the boundary of the 2 beats in the automatic accompaniment mode, the processing to change an accompaniment pattern, i.e., the processing to change a read address is performed in accordance with the number of notes detected at the point. That is, whether or not the current position is the boundary of 2 beats is first determined (step S64). This is achieved by determining whether the content of the step time counter is a multiple of "24" in which counter the counting up is started at the same time as the automatic accompaniment is started. If it is determined that the automatic accompaniment does not reach to the boundary of 2 beats, the control returns from the keyboard event processing routine to the main processing routine. That is, the change of accompaniment pattern is not executed until the automatic accompaniment reaches to the boundary of 2 beats.

Figure 18A:
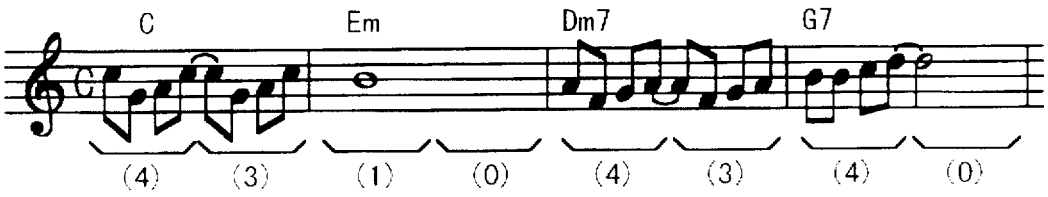
FIGS. 18A and 18B are musical scores illustrating an example of change of the accompaniment pattern when the automatic accompaniment is performed by the automatic accompaniment apparatus according to the second embodiment of the present invention.
Figure 18B:
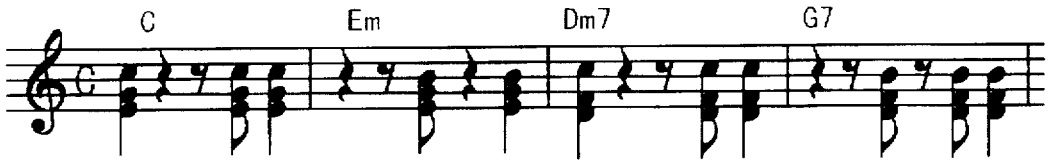

On the other hand, if it is determined in the above step S64 that the automatic accompaniment reaches the boundary of 2 beats, the table is referred to set a read address in the address register (step S65). That is, either one of the read addresses ADR1 and ADR3 of the accompaniment patterns corresponding to the content of the note counter, i.e., the number of notes is taken out from the table (see FIG. 14) which is stored in the table data memory 34 and set in the address register. The accompaniment pattern selecting section 14 of the automatic accompaniment apparatus according to the second embodiment of the present invention is realized by the processing of the step S65. As shown in, for example, FIG. 18A, if four notes are detected in the first 2 beats, the head address ADR3 of the automatic accompaniment data corresponding to the synthetic accompaniment pattern is set in the address register. In this case, in the following 2 beats, automatic accompaniment is performed by use of the synthetic accompaniment pattern, as shown in FIG. 18B.

Similarly, if three notes are detected within the following 2 beats, i.e., the 2 beats in the second half of the first measure, the head address ADR1 of the automatic accompaniment data corresponding to the first accompaniment pattern is set in the address register. Thereby, the automatic accompaniment is performed based on the first accompaniment sub-pattern in the following 2 beats, the 2 beats of the first half of the second measure, as shown in FIG. 18B. Hereinafter, the same is performed.

Next, the read address is updated (step S66). The update of the read address is the same as the processing of the step S36 in the above-mentioned first embodiment. Next, the content of the note counter is cleared (step S67). Thus, the preparation to count the number of notes which emerges within the following 2 beats completes. After that, the control returns from the keyboard event processing routine to the main processing routine.

(2d) The Automatic accompaniment Processing Routine

Because the processing which is used in the first embodiment shown in FIG. 10 is used just as it is as the automatic accompaniment processing in the second embodiment of the present invention, the description will be omitted.

In the example explained above, automatic accompaniment data is previously stored in the automatic accompaniment data memory 33, and the information which relates the number of notes and each accompaniment pattern, i.e., the read address is previously stored in the table data memory 34. However, a user may produce the table which relates automatic accompaniment data and the number of notes and an accompaniment pattern as the case of the above-mentioned first embodiment.

(3) The Third Embodiment

Figure 19:
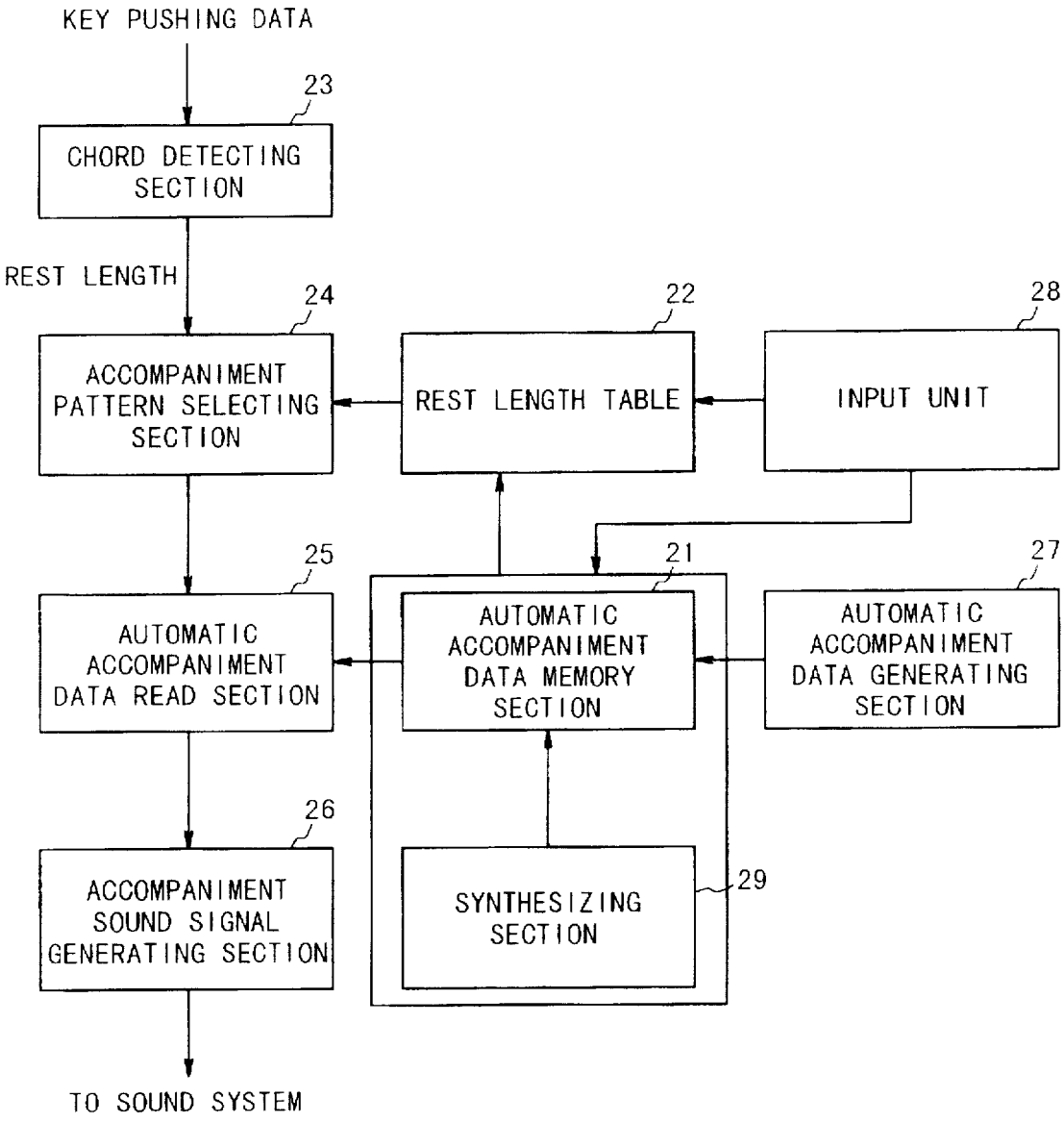
FIG. 19 is a functional block diagram of the automatic accompaniment apparatus according to the third embodiment of the present invention.

Next, the automatic accompaniment apparatus according to the third embodiment of the present invention will be described below. In the automatic accompaniment apparatus in the third embodiment, automatic accompaniment is performed while changing an accompaniment pattern depending on a rest length which is generated based on an operation of the keyboard unit 35. FIG. 19 is a functional block diagram illustrating the structure of the automatic accompaniment apparatus in the third embodiment. In the third embodiment, a rest length detecting section 23 is provided in place of the chord detecting section 3 in the first embodiment. Also, a rest length table 22 is provided in place of the chord type table 2. The accompaniment pattern selecting section 24 refers to the rest length table 22 based on the detected rest length from the rest length detecting section 23 to select an automatic accompaniment data to be read out. The other sections are the same as in the first embodiment.

FIG. 20 illustrates an example of the rest length table 22 stored in the table data memory 34 used in the third embodiment. In the rest length table 22 are stored the read addresses ADR1 and ADR3 corresponding to an accompaniment pattern to be performed when a rest length is detected. In the figure, if (the detected rest length)≧(quarter rest length), the read address SDR1 for the first accompaniment sub-pattern is selected and if (the detected rest length)<(quarter rest length), the read address SDR3 for the synthetic accompaniment pattern is selected. In the following description, a rest length is detected for every 2 beats.

(3a) The Main Processing Routine

Because the processing of the flow chart shown in FIG. 7 which is used in the first embodiment which is used just as it is, as the main processing routine in the third embodiment of present invention, the description will be omitted.

(3b) The Panel Processing Routine

Figure 21:
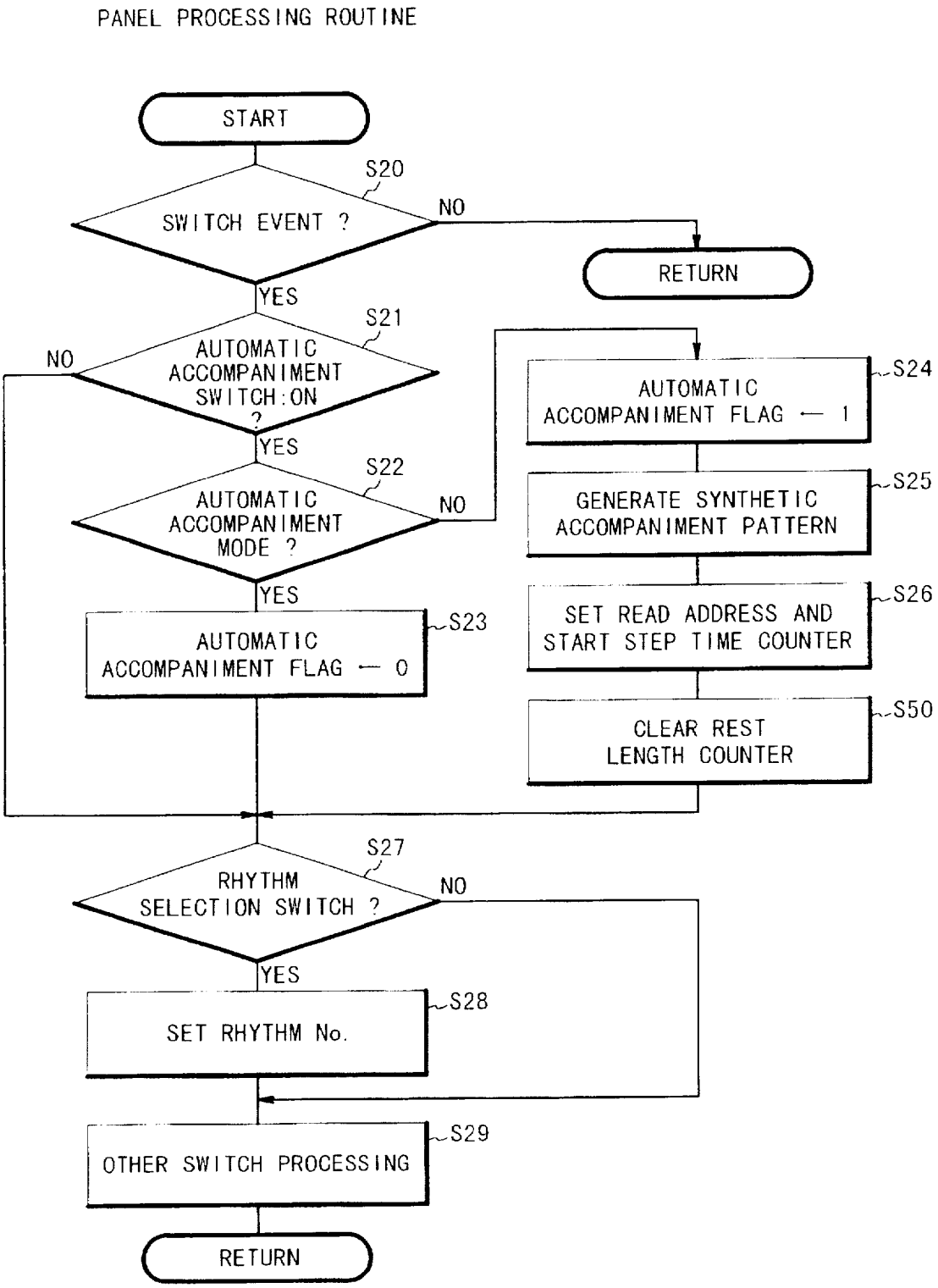
FIG. 21 is a flow chart illustrating a panel processing routine which is used in the third embodiment of the present invention.

The detail of the panel processing routine is shown in the flow chart of FIG. 21. The panel processing routine in the third embodiment (FIG. 8) is almost the same panel processing routine as in the first embodiment. Therefore, the same portions are assigned with the same reference numerals to simplify the description, and the different portion will be described.

In the step S25 of FIG. 21, an automatic accompaniment data for the synthetic accompaniment pattern is produced as in the above-mentioned first embodiment. In the automatic accompaniment processing routine in the third embodiment, as the accompaniment pattern to be automatically accompanied, either one of the first accompaniment sub-pattern corresponding to the read address ADR1 and the synthetic accompaniment pattern corresponding to the read address ADR3 in accordance with the detected rest length, as shown in FIG. 20. In the step S26 of FIG. 21, the read address ADR1 is set in the address register and the step time counter is started to count up. Thus, before a rest length is first detected, i.e., during 2 beats from the start of automatic accompaniment, the automatic accompaniment is performed based on the first accompaniment sub-pattern.

In a step S70 which is added in the third embodiment, a rest length counter is cleared. The rest length counter is the counter which is provided in the work memory 32 and is used to count a rest length. By this step S70, the function to initialize the rest length counter when the automatic accompaniment apparatus is set the automatic accompaniment mode by an automatic accompaniment switch is realized.

(3c) The keyboard Event Processing Routine

Figure 22:
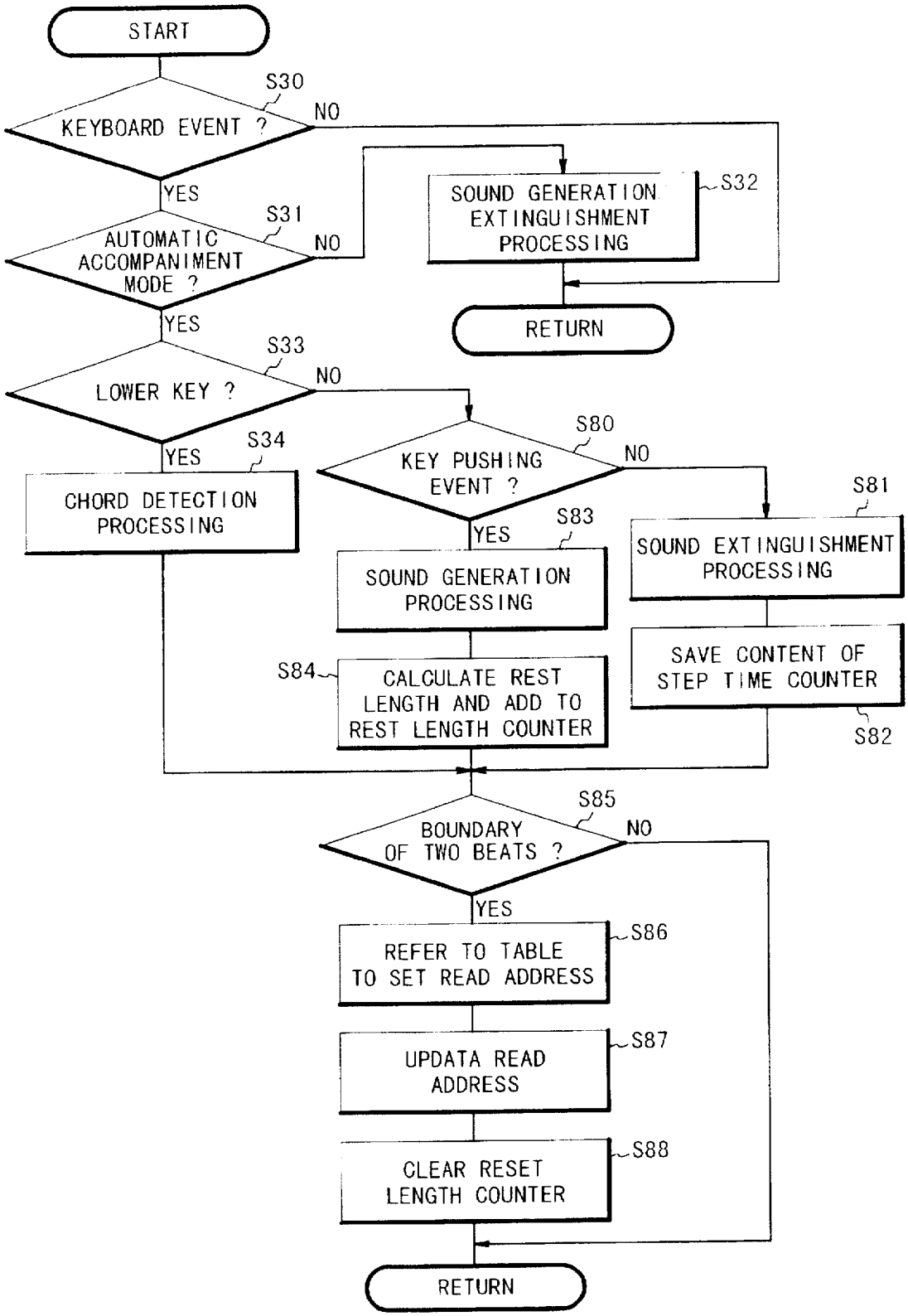
FIG. 22 is a flow chart which shows a keyboard event processing which is used in the third embodiment of the present invention.

The detail of the keyboard event processing is shown in the flow chart of FIG. 22. The keyboard processing contains the same processing portions as in the first embodiment (FIG. 9). Therefore, the same reference numbers are allocated to the same portions and the description will be made simply and the difference portions will be described in detail. In the third embodiment, an upper key is used to generate a single sound.

The processing of the steps S30 to S34 is the same as in the keyboard event processing in the above-mentioned first embodiment. In the third embodiment, after the chord detecting processing of the step S34 is ended, the control advances to a step S85.

When it is determined in the above step S33 that an operated key is not a lower key but an upper key, whether the keyboard event corresponding to the upper key is a key pushing event or a key releasing event is determined (step S80). If it is determined that the keyboard event is not any key pushing event, it is recognized that the key releasing event occurred and the sound extinguishment processing is executed (step S81). The sound extinguishment processing is executed in the same manner as in the above-mentioned first embodiment. Next, the content of the step time counter is saved (step S82). That is, the content of the step time counter at the time when the key releasing event occurs is saved in a predetermined buffer of the work memory 32. The content of the buffer is used for the computation of rest length to be mentioned later. After that, the control advances to the step S85.

When it is determined in the above step S80 that the keyboard event is the key pushing event, sound generation processing is executed (step S83). The sound generation processing is executed in the same manner as in the above-mentioned first embodiment.

In the processing of these steps S80, S81 and S83, in the automatic accompaniment mode, it is made possible to perform a melody using the upper key.

Next, a rest length is calculated and the calculating result is added to the rest length counter (step S84). That is, the step time which has been saved in the predetermined buffer of the work memory 32 at the time of the key releasing in the last time is subtracted from the content of the step time counter at the time of the key pushing this time so that the rest length is calculated. The calculated rest length is added to the rest length counter. In this manner, the lengths of the rests appearing during 2 beats are summed in the rest length counter. The rest length detecting section 23 of the automatic accompaniment apparatus according to the third embodiment of the present invention is realized by the processing of this step S84.

In a step S85 and the subsequent steps, the processing to change an accompaniment patter, i.e., the read address at the time when the automatic accompaniment proceeds to the boundary of the 2 beats in the automatic accompaniment mode is executed. For this purpose, whether or not the automatic accompaniment proceeds to the boundary of the 2 beats is first determined (step S85). This is performed in the same manner as the step S64 in the above-mentioned second embodiment. If it is determined that it does not proceeds to the boundary of the 2 beats, the control returns from the keyboard event processing routine to the main processing routine. That is, the change of the accompaniment pattern is not executed until the automatic accompaniment proceeds to the boundary of the 2 beats.

On the other hand, if it is determined in the step S85 that the automatic accompaniment proceeds to the boundary of the 2 beats, the table is referred to such that the read address is set in the address register (step S86). That is, one of the read addresses ADR1 and ADR3 for the accompaniment pattern corresponding to the content of the rest length counter, i.e., the rest length is read out from the rest length table 22 (FIG. 20) which is stored in the table data memory 34 and set in the address register from the table (the FIG. 20) which is stored in table data memory 34. The accompaniment pattern selecting section 24 of the automatic accompaniment apparatus according to the third embodiment of the present invention is realized by the processing of this step S96.

Figure 23A:
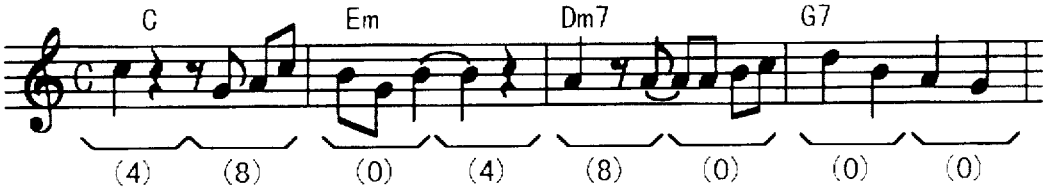
FIGS. 23A and 23B are musical scores illustrating an example of change of the accompaniment pattern when the automatic accompaniment is performed by the automatic accompaniment apparatus according to the third embodiment of the present invention.
Figure 23B:
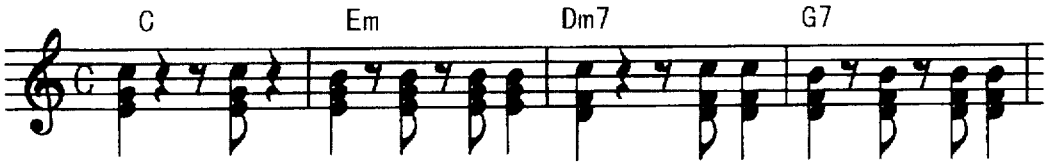

As shown in FIG. 23A, for example, when a quarter rest is detected within the first 2 beats, the read head address ADR1 of the automatic accompaniment data which corresponding to the first accompaniment sub-pattern is set in the address register. In this case, as shown in FIG. 23B, automatic accompaniment is performed based on the first accompaniment sub-pattern in the following 2 beats. When the eighth rest is detected in the same way within the following 2 beats, i.e., the 2 beats of the second half of the first measure, the head read address ADR3 of the automatic accompaniment data corresponding to the synthetic accompaniment pattern is set in the address register. Thereby, the automatic accompaniment is performed based on the synthetic accompaniment pattern in the following 2 beats, i.e., the 2 beats of the first half of the second measure, as shown in FIG. 23B. Hereinafter, the same operation is repeated.

Next, the update of the read address is executed (step S87). The update of the read address is executed in the same manner as the processing of the step S36 in the above-mentioned first embodiment. Next, the content of the rest length counter is cleared (step S88). Thus, the preparation to calculate the length of rests which appear during the following 2 beats completes. After that, the control returns from the keyboard event processing routine to the main processing routine.

(3d) The Automatic Accompaniment Processing Routine

The automatic accompaniment processing routine shown in FIG. 10 which is used in the first embodiment is used in the third embodiment of the present invention as it is. Therefore, the description will be omitted.

In the example explained above, the automatic accompaniment data is previously stored in the automatic accompaniment data memory 33. The information which relates a rest length and each accompaniment pattern, i.e., read address is previously stored in the table data memory 33. However, like the above-mentioned first embodiment, the user may produce the automatic accompaniment data and the table relating between the rest lengths and the accompaniment patterns.

As described above, according to the present invention, the automatic accompaniment can be performed to be full of variety while suppressing memory capacity small. Also, the automatic accompaniment can be performed while changing an accompaniment pattern in accordance with the performance and operation by the user.

What is claimed is:

1. An automatic accompaniment apparatus comprising:

storage means for storing a plurality of accompaniment patterns, and a plurality of corresponding automatic accompaniment data;

detecting means for detecting at least one of a content of a melody or a chord of a music to be performed, and producing a specifying data based on the detected at least one content or chord;

selecting means for selecting at least one of said plurality of accompaniment patterns based on said specifying data, and selecting at least one of said plurality of accompaniment data corresponding to said selected accompaniment pattern; and accompaniment sound signal generating means for generating an accompaniment sound signal based on said selected automatic accompaniment data.

2. An automatic accompaniment apparatus according to claim 1, wherein said selecting means includes:

a table for storing a relating information for relating said specifying data and at least one of said plurality of accompaniment patterns; and accompaniment data selecting means for referring to said table based on said specifying data to select at least one of said plurality of accompaniment patterns relating to said specifying data and selecting at least one of said plurality of automatic accompaniment data corresponding to said selected accompaniment pattern.

3. An automatic accompaniment apparatus according to claim 1, wherein said specifying data is data indicative of a chord type.

4. An automatic accompaniment apparatus according to claim 3, wherein said detecting means includes:

a keyboard unit having a plurality of keys;

key board data generating means for, when at least one of said plurality of keys of said keyboard unit is operated by a user, generating a keyboard data corresponding to said at least one operated key; and chord detecting means for detecting said chord type from said keyboard data to generate said specifying data.

5. An automatic accompaniment apparatus according to claim 1, wherein said specifying data is data indicative of a number of notes during a predetermined time period.

6. An automatic accompaniment apparatus according to claim 5, wherein said detecting means includes:

a keyboard unit having a plurality of keys;

key board data generating means for, when at least one of said plurality of keys of said keyboard unit is operated by a user, generating a keyboard data corresponding to said at least one operated key; and note detecting means for detecting said number of notes from said keyboard data to generate said specifying data.

7. An automatic accompaniment apparatus according to claim 1, wherein said specifying data is a data indicative of a rest length within a predetermined number of measures.

8. An automatic accompaniment apparatus according to claim 7, wherein said detecting means includes:

a keyboard unit having a plurality of keys;

key board data generating means for, when at least one of said plurality of keys of said keyboard unit is operated by a user, generating a keyboard data corresponding to said at least one operated key; and rest length detecting means for detecting said rest length from said keyboard data to generate said specifying data.

9. An automatic accompaniment apparatus according to claim 1, wherein said storage means stores a plurality of accompaniment pattern sets, each of which is composed of at least one said plurality of accompaniment patterns, and wherein said automatic accompaniment apparatus further comprises:

panel means having a plurality of operation elements for inputting data;

panel data generating means for, when at least one operation element of said panel means is operated by the user, generating a panel data based on the at least one operated operation element; and designating means for designating one of said plurality of accompaniment pattern sets based on said panel data.

10. An automatic accompaniment apparatus according to claim 1, further comprising:

panel means having a plurality of operation elements for inputting data;

panel data generating means for, when at least one operation element of said panel means is operated by the user, generating a panel data based on the at least one operated operation element; and accompaniment pattern generating means for generating a new accompaniment pattern from at least two of said plurality of accompaniment patterns based on said panel data.

11. An automatic accompaniment apparatus according to claim 1, further comprising:

communication means for externally receiving another automatic accompaniment data and generating and storing in said storage means another accompaniment pattern related to said other received automatic accompaniment data.

12. An automatic accompaniment apparatus according to claim 1, wherein said selecting means includes a table for storing a relating information for relating said specifying data to at least one of said plurality of accompaniment patterns, and wherein said automatic accompaniment apparatus further comprises:

panel means having a plurality of operation elements, for inputting data;

panel data generating means for, when at least one operation element of said panel means is operated by the user, generating a panel data based on the at least one operated operation element; and table generating means for generating said table based on said panel data.

13. A method of performing automatic accompaniment comprising the steps of:

detecting at least one of a content of a melody or a chord of a music to be performed, and producing a specifying data based on the detected at least one content or chord;

selecting at least one of a plurality of accompaniment patterns, which are stored in a storage means, based on said specifying data;

selecting at least one of a plurality of accompaniment data corresponding to said selected accompaniment pattern, each of said plurality of accompaniment data corresponding to one accompaniment pattern; and generating an accompaniment sound signal based on said selected automatic accompaniment data.

14. A method of performing automatic accompaniment according to claim 13, wherein said step of selecting at least one of said plurality of accompaniment patterns includes referring to a table based on said specifying data to select at least one of said plurality of accompaniment pattern relating to said specifying data.

15. A method of performing automatic accompaniment according to claim 13, wherein said specifying data is data indicative of a chord type.

16. A method of performing automatic accompaniment according to claim 15, wherein said detecting step includes:

when at least one of a plurality of keys of a keyboard unit is operated by a user, generating a keyboard data based on the at least one operated key; and detecting said chord type from said keyboard data to generate said specifying data.

17. A method of performing automatic accompaniment according to claim 13, wherein said specifying data is data indicative of a number of notes.

18. A method of performing automatic accompaniment according to claim 17, wherein said detecting step includes:

when at least one of a plurality of keys of a keyboard unit is operated by a user, generating a keyboard data based on the at least one operated key; and detecting said number of notes from said keyboard data to generate said specifying data.

19. A method of performing automatic accompaniment according to claim 13, wherein said specifying data is data indicative of a rest length.

20. A method of performing automatic accompaniment according to claim 19, wherein said detecting step includes:

when at least one of a plurality of keys of a keyboard unit is operated by a user, generating a keyboard data based on the at least one operated key; and detecting said rest length from said keyboard data to generate said specifying data.

21. A method of performing automatic accompaniment according to claim 19, further comprising the steps of:

operating a panel having a plurality of operation elements;

generating a panel data in response to the operation of said panel; and generating a new accompaniment pattern from at least two of said plurality of accompaniment patterns based on said panel data.

22. A method of performing automatic accompaniment according to claim 13, further comprising the steps of:

receiving another automatic accompaniment data and generating and storing in said storage means another accompaniment pattern related to said other received automatic accompaniment data.

23. A method of performing automatic accompaniment according to claim 14, further comprising the steps of:

operating a panel having a plurality of operation elements;

generating a panel data in response to the operation of said panel; and generating said table based on said panel data.

* * * * *